US012209340B2

(12) United States Patent
Myers et al.

(10) Patent No.: US 12,209,340 B2
(45) Date of Patent: Jan. 28, 2025

(54) HEM FORMATION FOR AUTOMATED GARMENT MANUFACTURE

(71) Applicant: CreateMe Technologies LLC, New York, NY (US)

(72) Inventors: Thomas C. K. Myers, New York, NY (US); Khamvong Thammasouk, San Jose, CA (US)

(73) Assignee: CreateMe Technologies Inc., Newark, CA (US)

( * ) Notice: Subject to any disclaimer, the term of this patent is extended or adjusted under 35 U.S.C. 154(b) by 111 days.

(21) Appl. No.: 17/988,662

(22) Filed: Nov. 16, 2022

(65) Prior Publication Data

US 2023/0272568 A1 Aug. 31, 2023

Related U.S. Application Data

(63) Continuation of application No. 17/566,512, filed on Dec. 30, 2021, now abandoned.

(51) Int. Cl.
*D05B 35/02* (2006.01)
*A41D 27/24* (2006.01)
(Continued)

(52) U.S. Cl.
CPC ..... *D05B 35/02* (2013.01); *A41D 27/24* (2013.01); *A41H 33/00* (2013.01); *A41H 42/00* (2013.01);
(Continued)

(58) Field of Classification Search
CPC ..... D05B 35/02; D05B 35/04; D05B 35/062; D05B 35/085; A41H 43/0257;
(Continued)

(56) References Cited

U.S. PATENT DOCUMENTS 2,656,763 A 10/1953 Frost
3,133,516 A * 5/1964 Gorin ..... D05B 35/085 112/132
(Continued)

FOREIGN PATENT DOCUMENTS

DE 202017006591 U1 * 12/2018 ..... A41H 33/00
EP 0375524 A1 6/1990
GB 1358344 A * 7/1974 ..... A41D 27/20

OTHER PUBLICATIONS

Merriam-Webster, "notch"; https://www.merriam-webster.com/dictionary/notch (last visited Oct. 3, 2023). (Year: 2023).

*Primary Examiner* — Patrick J. Lynch

(74) *Attorney, Agent, or Firm* — Moore Intellectual Property Law, PLLC

(57) ABSTRACT

A method and tooling for manufacturing flexible articles of manufacture such as garments, bags, backpacks and accessories that require hemmed edges. The method and tooling are compatible for use in an automated system and simplify the hemming process by performing the hemming operation on a flat pattern of material before the pattern of material has been joined with other patterns of material to form a finished or intermediate three-dimensional workpiece. This facilitates the formation of the hem by allowing the hem to be formed on a flat material pattern on a flat surface, thereby facilitating the folding, creasing and affixing of the hem without the requirement of human dexterity and labor.

20 Claims, 32 Drawing Sheets

(51) Int. Cl.
*A41H 33/00* (2006.01)
*A41H 42/00* (2006.01)
*A41H 43/02* (2006.01)

(52) U.S. Cl.
CPC ..... *A41H 43/02* (2013.01); *D05D 2305/06* (2013.01)

(58) Field of Classification Search
CPC ..... A41H 33/00; D05D 2305/02; D05D 2305/04; D05D 2305/06
See application file for complete search history.

(56) References Cited

U.S. PATENT DOCUMENTS 3,620,525 A * 11/1971 Hawley ..... D05B 33/00 493/417
3,681,785 A 8/1972 Truman
3,699,591 A 10/1972 Breitkopf
4,287,841 A * 9/1981 Rovin ..... D05B 25/00 112/470.07
4,357,197 A 11/1982 Wilson
4,561,126 A 12/1985 Truman
4,951,586 A * 8/1990 Becherini ..... D05B 3/22 112/141
5,454,336 A * 10/1995 Iwasaki ..... D05B 35/04 112/470.16
5,795,433 A 8/1998 Niedermeyer
5,938,243 A 8/1999 De Santo
11,564,435 B2 1/2023 Chope
2002/0002938 A1 1/2002 Alberts
2002/0005153 A1 1/2002 Ribble
2002/0005155 A1 1/2002 Nelson
2002/0006855 A1 1/2002 Alberts
2002/0152725 A1 10/2002 Ozeki
2004/0074428 A1* 4/2004 Marcangelo ..... D05B 11/005 112/144
2005/0049130 A1 3/2005 Kosa
2007/0157861 A1* 7/2007 Kovach ..... D05B 33/003 112/2

* cited by examiner

No cutting or folding before joining and the two webs are joined face to face (inner or outer) to form Simple Peel Seam.

Web 2 is cut or folded before its outer face is joined to the inner face of Web 1 to form Simple Lap Seam.

Web 2 is cut or folded before its outer face is joined to the inner face of Web 1 to form Double Lap Seam.

HEM FORMATION FOR AUTOMATED GARMENT MANUFACTURE

This Application claims priority to Ser. No. 17/566,512, filed Dec. 30, 2021, which is incorporated herein by reference.

FIELD OF THE INVENTION

The present invention relates to systems and methods for automated fabrication of garments and similar articles, and more particularly to a process for forming hems prior to seam formation for facilitation of automation.

BACKGROUND

Despite technological advances and introduction of automation in many types of manufacturing, garment manufacturing remains very labor intensive. Sewing machines were invented in the early nineteenth century and were made possible based on the development of the lock stitch sewing technique. Today, some hundred fifty years later, this same technology remains the foundation of garments manufacturing. The modern process of producing large quantities of ready-to-wear apparels relies heavily on manual labor and relative to other industrial manufacturing it remains inefficient. Garment manufacturing includes multiple steps including size, folding, fitting, cutting, sewing, material handling. The type of tasks needed dictates the level of skilled labor that is required to perform the work. The unique and varied properties of fabric such as weight, thickness, strength, stretchiness and draping as well as the complicated nature of tasks required in apparel manufacturing complicates material handling and automated garment manufacturing.

The garment manufacturing process starts with cutting one or more layers of fabric based on patterns and dimensions matching the desired garment. Then, the cut fabric patterns are transferred from workstation to workstation, where at each workstation, one, two or more pieces of fabrics are manually folded, overlapped along the seams and fed into a sewing or serger (overlocker) machine. Given the variety of fabrics, threads, seam types and stitch types found in a finished garment, a larger number of workstations with specialized tools and skilled operators is required for assembling a garment. This means the fabrics or unfinished garments spend a lot of time in transit between workstations. Unlike most many manufacturing industries benefiting from twenty first century innovations and advances in material handling in most small and large apparel manufacturing factories, most of the material handling and apparel manufacturing operations are conducted in a manual or semi-manual manner.

Currently, despite advances in technology, machines still struggle with performing certain tasks that are easily handled by a trained worker with average hand-eye coordination skills. This is one reason garment manufacturing industry is in a constant search of cheaper human labor rather than investing in advanced automated manufacturing systems. So, in many cases, the difference between small and large garment manufacturing operations is the number of workers it engages. To increase production, a factory may add additional production lines in parallel. However, in general, increasing production in this manner does little to improve efficiency. Even in large factories, most work is performed in piecemeal fashion, with limited coordination between various stations/steps, and movement of material between each station requires a great deal of manual product handling, Therefore, the entire garment manufacturing process remains labor intensive and inefficient, where work is performed in a discontinuous batch processing fashion, causing apparel manufacturers to move from country to country in a continuous search lower labor costs for manual and semi-skilled labor.

Most of the innovations in the garment manufacturing industry have been directed to improving individual tools. For example, new features may be added to a sewing machine to convert it from manual to a semi-automatic or automatic tool. However, all material handling needs would still require a manual manipulation, including loading, unloading piecemeal work in and off the tool.

Few garment manufacturing innovations attempt to address the inefficiencies of the apparel manufacturing process at the system level. Continuous methods and systems have been proposed but all include limitations that have prohibited mass implementation of the system. US reissue patent Re. 30,520 describes a "Method of Manufacturing Jackets and Like Garments" in an assembly line fashion, using at least two webs of fabric, one used to form the jacket and one used to form the sleeves. Although this patent proposes a continuous manufacturing process, garment formation restrictions force sleeve holes that extend to the neck hole, resulting in a garment with an undesirable shape and design, which may be at least one reason this manufacturing system does not appear to have been implemented in any production facility.

U.S. Pat. No. 3,681,785 entitled "Garment Production with Automatic Sleeve Placement" describes a continuous garment manufacturing system where left and right preformed sleeves are placed and secured to the back panel of a jacket or shirt that is patterned on a continuously moving web. The system proposed in this patent requires the accurate registration and synchronization of the movement of garment body web to match the movement and placement of each individual sleeve accurately with respect to a moving web under very tight manufacturing tolerances. This synchronization is further complicated by the proposed handling of each sleeve, lacking stiffness and yet required to be flipped 180 degrees from their resting position onto its destined location on garment body on the web. The material handling requirements of the '785 patent are impractical and due to the pliable nature of any garment fabric and the required accurate placement of the sleeves on the garment body on the web.

Similarly, U.S. Pat. No. 3,696,445 entitled "Garment Making Method," and U.S. Pat. No. 4,493,116 entitled "Method for Manufacturing Sleeved Garments" propose manufacturing methods for forming garments in an automated process. As in the previous disclosures, both '445 and '116 propose forming sleeves in a separate operation and attaching the sleeves in a synchronized fashion to the garment body, requiring timely and complicated cutting, placing and attaching operations that render the implementation of the proposed methods impractical.

Another constraint in today's garment manufacturing is the inability to efficiently produce in small batches or mass produce customized garments tailored to every consumer's body shape and measurements. Manufactures rely on economies of scale and require minimum order quantity which may be out of reach for small brands and designers. Given the heavily manual and piecemeal processes in the current manufacturing operations, small batches or mass customized production that requires constantly shifting product designs, material selections and size and sewing techniques result in production difficulties and resulting manufacturing errors and resulting lower yields. To satisfy the growing need in fulfilling small batch or mass customized orders, garment manufacturing systems that are highly automated, programmable, and reconfigurable to accommodate an increasing mix of design, material selection, size and joining techniques are desired.

SUMMARY

The disclosed embodiments provide a method for forming an article of manufacture that includes supporting a flexible material on a flat surface, and cutting the flexible material to form a notch of material. The notch of material is folded and affixed to a portion of the flexible material to form a hem. After forming the hem, one or more seams are formed to construct a three-dimensional product.

Forming the hem or seam while the material is held on a flat surface and before performing further seaming greatly simplifies the formation of the hem or seam. This advantageously facilitates the hem or seam formation in an automated system as compared with traditional hem or seam formation wherein a hem or a seam on an item such as a garment is formed after various material patterns are joined together to construct to form a three-dimensional structure such as a garment or other structure. Throughout this disclosure, hem or seam will be used interchangeably to refer to any finishing of an edge of fabric to form a mechanically and/or aesthetically pleasing joint.

In one embodiment, the method can also include applying a bonding agent to the material to affix the notch of material to a portion of the flexible material. In one embodiment, the formation of the hem can include forming a crease and sewing the notch of material to the portion of the flexible material.

In one embodiment, the formation of the hem can include applying one or more of heat, steam, starch or size to the flexible material and applying physical pressure to form a crease. In one embodiment the flexible material can be one or more of fabric, felt, leather, vinyl and upholstery. In another embodiment, the three-dimensional product can be a garment, handbag, backpack or accessory. In another embodiment, the formation of the seams to form a three-dimensional product further comprises attaching the flexible material to another portion of material.

The disclosed embodiments also provide a method for manufacturing a product from flexible material that includes defining first and second patterns on first and second portions of flexible material, and determining a location of the first and second portions that require hem. The flexible material is then cut at that location, and is folded and affixed to form a hem. After forming the hem, one or more seams are formed to connect the first and second portions together, and the first and second patterns are cut from the material to form a workpiece.

In one embodiment a hem is formed on each of the first and second portions of material. In one embodiment, the hem is formed before the flexible material has been connected to another portion of flexible material.

In one embodiment the hem can be formed using a folding tool that is functional to fold, crease and press the cut flexible material. In one embodiment the folding tool can include a flat bottom and a back edge and is connected with an articulation mechanism. The folding tool can include openings for supplying one or more of heat, steam, air, starch or size to the flexible material. In another embodiment the cut can be in the form of a notch.

The disclosed embodiments also provide a tool for forming a hem in a flexible material. The tool includes a head having a flat base that is configured to fit under a piece of material and a back extending upward from the base. The tool also includes an articulating mechanism for moving the tool head in multiple dimensions, and a control system for controlling the articulating mechanism to slide the head under the material and fold the material.

In one embodiment the tooling head includes openings for supplying one or more of heat, steam, air, starch or size to the material. In one embodiment, the base of the folding tool head has a beveled edge to facilitate sliding the tooling head under the material. In another embodiment the articulating mechanism is configured to slide the tooling head under a portion of the flexible material and also to rotate the tooling head so as to bend, crease and press the piece of material.

BRIEF DESCRIPTION OF THE DRAWINGS

For a fuller understanding of the nature and advantages of this invention, as well as the preferred mode of use, reference should be made to the following detailed description read in conjunction with the accompanying drawings. The drawings are not presented to scale unless specified otherwise on an individual basis.

DETAILED DESCRIPTION

Figure 1:
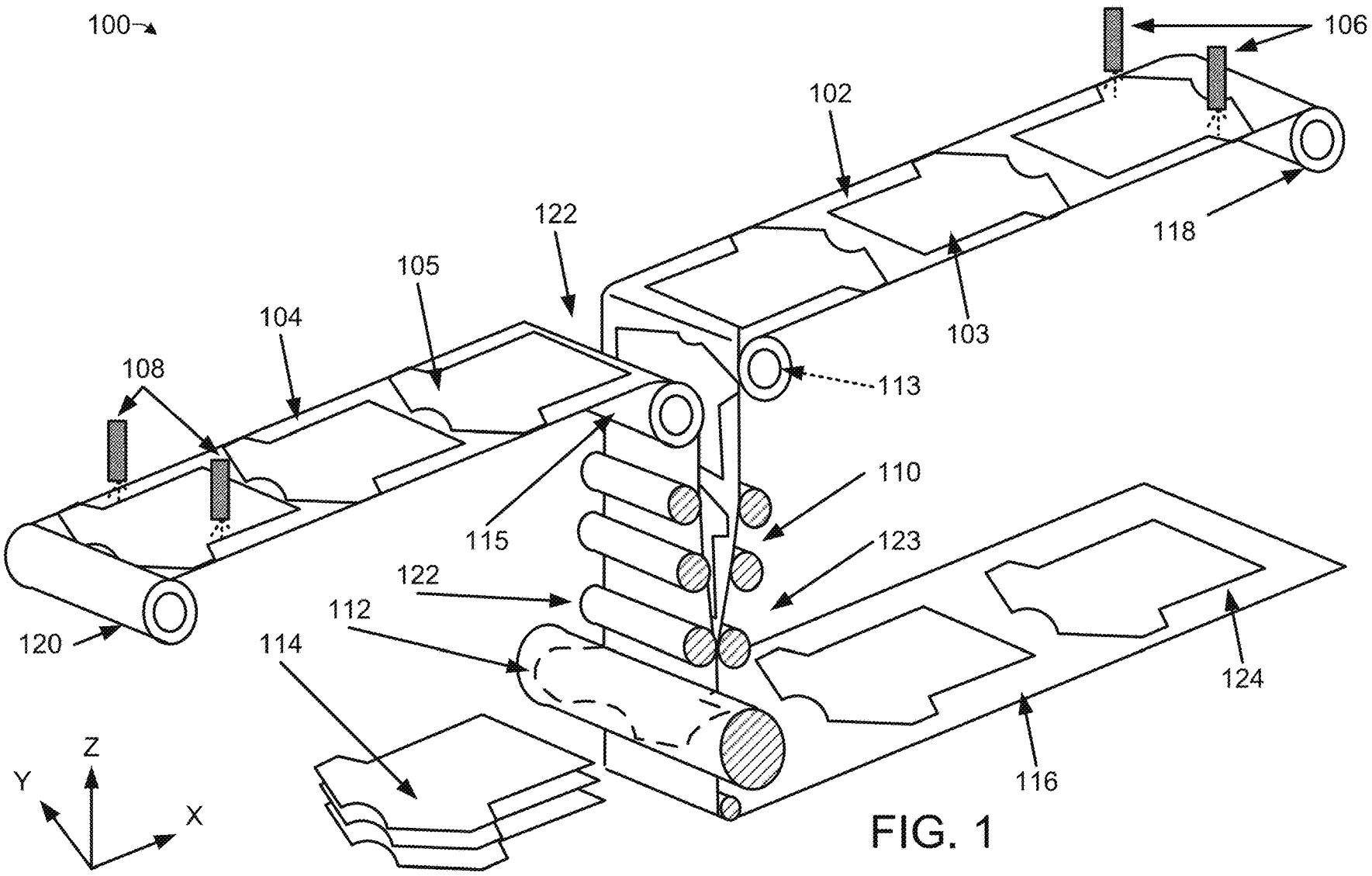
FIG. 1 shows an automatic garment manufacturing system according to some exemplary embodiments of the present invention.

The following description includes the best embodiments presently contemplated for carrying out the invention. This description is made for the purpose of illustrating the general principles of this invention and is not meant to limit the inventive concepts claimed herein in any way.

Some embodiments based on the present disclosure provide for systems and methods for transferring and manipulating fabrics and joining garment components during garment manufacturing in a way that is more suitable to automation. Some embodiments provide for garment manufacturing systems and methods that are reconfigurable to enable both mass production of customized garments and small batch processing with reduced human intervention.

As previously mentioned, traditional methods of making a garment require converting various measurements of body parts into two dimensional layouts (panels) corresponding to the various garment pieces or sections, cutting garment pieces out of webs of fabric, and using a variety of manual or semi-manual operations requiring a great deal of hand-eye coordination and manipulation to assemble together the various pieces of fabric to make a garment. This heavy reliance on manual processes is inefficient and limiting. Additionally, reliance on manual labor, especially labor with specialized skills is expensive, and inherently more prone to errors depending on the required skill, resulting in products lower yields due to higher defects, resulting in more rejections and increase costs. Simply put, the current garment manufacturing process remains heavily reliant on antiquated systems and processes carried over from the industrial revolution from the beginning of the 19th century. Therefore, it would be highly desirable to create systems and processes for garment manufacturing that lend themselves to significantly reduced reliance on manual product manipulation and handling, promote continuous garment manufacturing methods over piecemeal processing, and offer flexible systems that can mass produce items while allowing for customized production.

Embodiments based on the present disclosure cover processes that combine an adhesive to affect the permanent bonding of a variety of types of fabric, with a series of integrated mechanical processes to eliminate or greatly reduce material handling issues and the human intervention traditionally required in the garment manufacturing process. This will increase the speed and efficiency of the processes, improve the overall quality of the finished garments and provides for flexible systems that can mass produce items while allowing for customized production, whereby production items can be adjusted to individual size and style. Exemplary embodiments of the present invention provide for seam formation, joinder and cutting tools that are adaptable and programmable such as to allow automated and customizable garment manufacturing systems and processes.

Exemplary embodiments of the present disclosure will be described with reference to the manufacture of T-shirts. However, it would be understood that these described exemplary embodiments may be easily adapted to produce other types of garments including long sleeve shirts, dress shirts, jackets, pants, gloves, or non-garment products such as bedsheets, pillowcase, table cloth, rugs or handbags, etc. Therefore, the exemplary embodiments of this disclosure should not be interpreted as limiting the scope of the present disclosure.

Turning now to the drawings, FIG. 1 illustrates an automatic garment manufacturing system according to some exemplary embodiments of the present invention. The automated garment manufacturing system 100 of FIG. 1 is designed to eliminate or reduce manual labor. As shown in FIG. 1, system 100 includes a first web 102 including the back half 103 of a garment 114 (a T-shirt in the current example) corresponding to a given design and size. A second web of fabric 104 includes the front half 105 of the T-shirt 114.

In some embodiments, one or more webs may comprise a continuous flat layer of fabric laid out in two dimensions. In some embodiments, one or more of the webs may include shapes other than a flat sheet, including any three-dimensional shape such as a tube or other shapes. In some embodiments, the web may not include a continuous sheet of fabric. In some embodiments, the web may act as a scaffolding (not shown in the drawing) or carrier for fabric components that are secured to the web by some means and are acted on as the web travels through path. In some embodiments one or more webs may include perforations along one or more borders. In some embodiments, one or more webs may be coupled to a scaffolding (not shown in the drawing) that includes perforations along one or more borders. In some embodiments, one or more fabric webs (e.g., webs 102 and 104) may include perforated borders made of the same material as the web and integral to the web or made of the same or different material than the web and is attached to the one or more fabric web. In some embodiments, the border perforations of the web or the scaffolding may be used to pull the web along a given path pulled along by a system of one or more gears, providing control of the movement of the web, synchronize the movement of the web to other moving components of the exemplary manufacturing system. In exemplary embodiments, the sheet of fabric 102 is dispensed from the fabric role 118 that is operable to rotate about its axis and dispense the web 102 along the X-axis. Similarly, web 104 is dispensed from the fabric role 120 that is capable of rotating about its axis and dispensing the web 104 along the X-axis. In some embodiments, role 118 and/or role 120 are coupled to one or more actuators, gears, motors (continuous or step) that rotate at a selected speed pulling or pushing the web along the X-axis. In some embodiments, roles 118 and 120 are free to move but are not mounted on motorized shafts. In these exemplary embodiments, the webs 102 and 104 may be pulled by one or more actuators or motors located at suitable locations other than role 118 or 120 rods. In some embodiments, actuators or motors are located at rollers 113 and 115, rollers 122 and 123, rotary die roller 112, and/or other suitable locations, providing pull or push forces acting on the webs 102 and 104. In some embodiments, one or more rollers include actuating means that are operable to being actuated independently and activated in a way to distribute the application of the pull or push forces along the webs 102 and 104 to reduce the chances of damaging the fabric by overly stressing, straining or even tearing fabric web at one or more locations. In alternative embodiments, the webs 102 and 104 may have borders made of the same or different material, that may be perforated or include a greater friction coefficient, and where the border material is reinforced or inherently has greater tensile strength and provides for an area that may support and tolerate greater stress or strain forces than the fabric web materials can tolerate without affecting the quality of the fabric webs.

In some embodiments, the front half contour 105 and/or back half contour 103 of the T-shirt 114 include markings to further define the T-shirt 114's borders on the corresponding webs 102 and 104. In exemplary embodiments, the front half and back half contours 105 and 103 of the T-shirt 114 may be temporarily marked by visible, invisible, or washable ink. In other embodiments, no demarcation may be used to identify the contours of front half 103 or back half 105 of T-shirt 114. In some embodiments, the outer face of the back half 103 and front half 105 of the T-shirt 114 may be facing out as shown in FIG. 1. In some embodiments, back half 103 and front half 105 are arranged inside-out, so that the interior face of each half of T-shirt 114 would be facing out.

In exemplary embodiments, adhesive dispensers 106 and 108 dispense adhesive along the contours of the back half 103 and/or front half 105 of the T-shirt 114, except may be in the neckline region, sleeve opening and bottom opening of the T-shirt 114. The regions with no adhesive may remain open and form the neck, arms and body holes after the final cutting and finishing steps further described below.

In exemplary embodiments, after the deposition of the adhesive, web 102 and the web 104 continue to travel along the X axis toward a joinder point where webs 102 and web 104 are pressed together using one or more rollers (e.g. rollers 110, 122 and 123). In some embodiments, beyond the joinder point, the web 102 and web 104 are pressed together using a predetermined force, heat, radiation or moisture to activate any adhesive applied to the back half 103 and front half 105 of T-shirt 114, and attach the back half 103 and front half 105 of T-shirt 114 to form a integral complete garment. In some embodiments, in addition to pressure, heat, radiation or moisture are applied to web 102 and web 104. In some embodiments, the rollers 110, 122 and 123 supply pressure, heat, radiation, or moisture uniformly to the web 102 and web 104. In some embodiments, pressure, heat, radiation, or moisture may be applied only to certain regions of the back half 103 and front half 105 contours that have applied adhesive. In some embodiments, the pressure, heat, radiation, or moisture may not be applied through the rollers. In some embodiments, some or all the pressure, heat, radiation, or moisture may originate from sources other than the rollers 110, 122 and 123. In some embodiments, heat and radiation may be applied by conduction, radiation, or convection. In some embodiments, energy sources such as lasers, heat guns, or hot plates may supply the energy.

It should be apparent that synchronization of the movements of web 102 and web 104 are important. In some embodiments, mechanical means such as belts, chains gears and sprockets are used to actuate the movement of web 102 and 104 in sync. In some embodiments, electronic controls along with variable speed motors and/or step motor may be used to control the movement and speed of webs 102 and 104 in order to maintain web 102 and web 104's movement in synch and provide for the accurate registration and alignment of the back half 103 to the front half 105 of T-shirt 114. In some embodiments one or more webs may include perforations along one or more borders to be operable similar to a chain and sprocket conveyance mechanism operating on one or more webs 102 and 104, or any other webs (not shown in FIG. 1). In some embodiments, one or more webs may be coupled to a scaffolding (not shown in the drawing) that includes perforations along one or more borders. In some embodiments, the border perforations of the web or the scaffolding may be the mechanism that receive the conveyance forces propelling the web along its path, control the movement of the web, and synchronize the movement of the web to other moving components of the exemplary manufacturing system. Exemplary embodiments of this disclosure require the synchronization of fewer number of moving parts and allows for a more accurate control of the movement of any web, thus providing for exemplary systems and methods according to the present disclosure that are more easily implementable, resulting in improved production quality, fewer defects, a higher production yield and lower material and manufacturing costs.

With reference to FIG. 1, after one or more rollers 110, 122 and 123 join the back half 103 and front half 105 of T-shirt 114 together, the two halves of T-shirt 114 are permanently, pressed to for T-shirt 114. In some embodiments, multiple rollers 122 and 123 operate on the webs 102 and 104 to join them together at the contours of T-shirt 114, In some embodiments, the rotary die 112 may further cut T-shirt 114 along its borders and out of the joined webs 102-104. In some embodiments, the rotary dies may cut the garment outside of the adhesive bondline, at the edge of the bondline or along an area within the bondline. The bondline refers to the areas of the fabric panels that are joined to form seams or hems. In some embodiments, the rotary dies may apply heat energy simultaneously with or after the cutting operation to melt or remelt the adhesive, the fabric or both to produce finished seams that are aesthetically more desirable, physically durable (prevent fraying) or both. In some embodiments, programmable and controllable cutters may be used to cut out the formed garment (T-shirt 114) from the joined webs. In some embodiments, programmable and controllable cutters traveling along predetermined cutting paths may be used to detach the formed garment from the joined webs. In some embodiments, cutters may be directed or aided by machine vision and supporting artificial intelligence (AI) used to identify the actual bondline and cut along it or at an offset from the bondline. In some embodiments, the rollers 122 and 123 may be equipped with pressure sensing elements to detect any bulging that may correspond to when: bondlines are located and seams are formed and communicating the sensor readout in real-time to the programmable cutters for more accurate positioning and cutting operation. In some embodiments, T-shirt 114 may be cut to be completely free of the web 102404 combination. In some embodiments, fully or partially cutout T-shirt 114 may continue to travel on the web 124 to the next processing station. In some embodiments, instead of cutting, the garment 114's borders are perforated by needles that may result in garment 114 that may remain partially attached to the joined webs 102-104, for further processing to allow for easier handling of the garment 114 during processing. The garment 114 with perforated perimeter may be fully detached from the web during a cutting or stamping operation, at which point garment 114 is fully detached from the joint web 110-104. In some embodiments, the detached I-shirts 114 are separated from the web 102-104 and collected for further processing at subsequent operating stations where the T-shirt 114 may be processed to receive a collar, hemming of the sleeves, adding pockets, zippers, embroidery and packaging. In some embodiments the joined web 102-104 leftover material 116 may accumulate on a roller for ultimate disposal. In some embodiments, the leftover 116 of the joined 102-104 is further processed to form components used for forming liners, pockets, seams, hemlines, necklines, or sleeve openings as described further below.

In some embodiments, T-shirts 114 remain fully or partially attached to the web 102-104 to continue to travel as part of the web 102-104 for easier material handling during additional processing. In some embodiments, additional processing may include customization operation of garment 114 including embroidery, DTG (direct-to-garment) printing, screen printing, etc. In some embodiments, after all processing is completed, T-shirts 114 are cutout of the web 102-104 and processed for final packaging.

Figure 2:
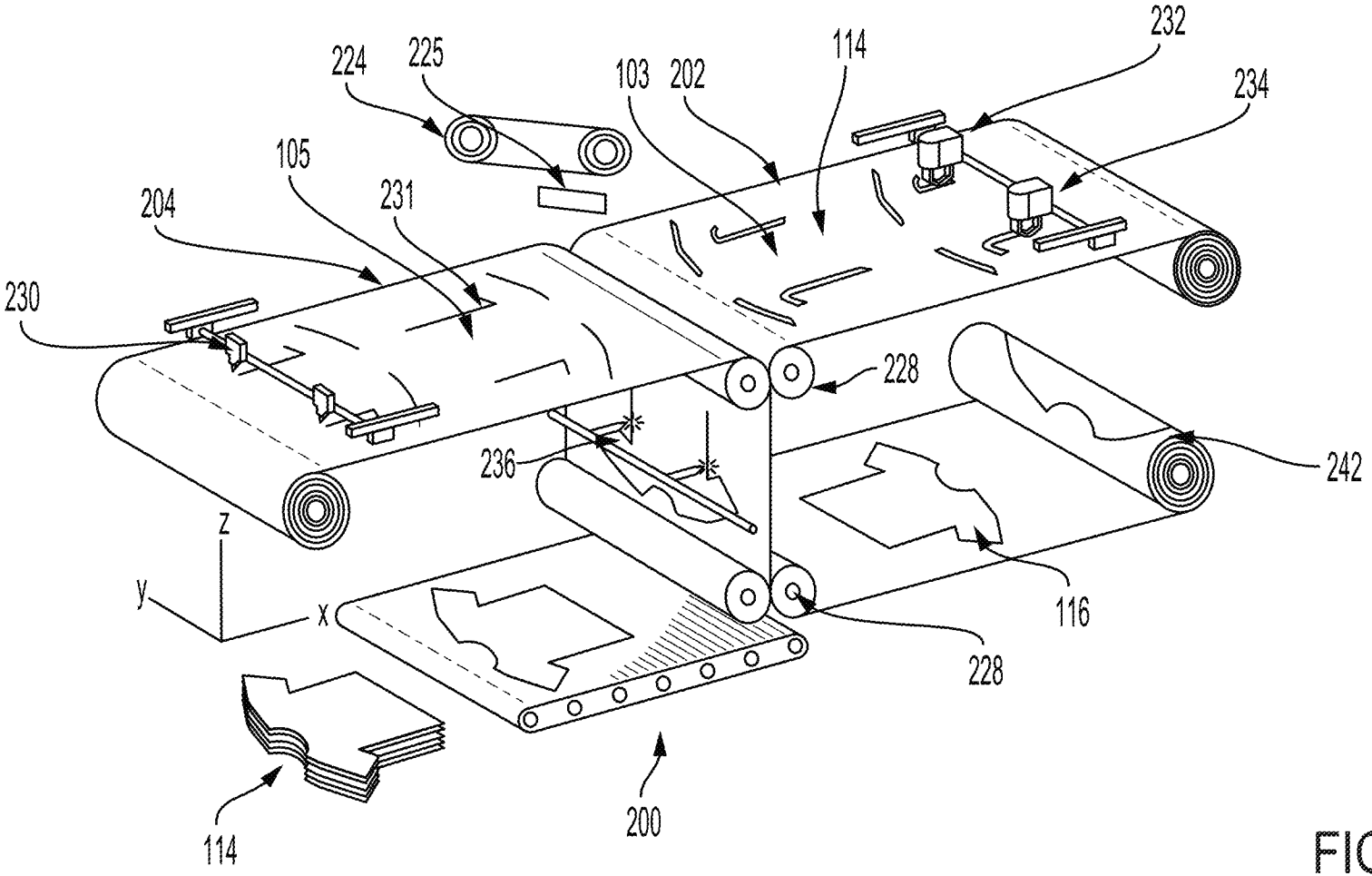
FIG. 2 illustrates a simplified depiction of the webs of fabric according to some exemplary embodiments of the present invention.

FIG. 2 illustrates another automatic garment manufacturing system according to some exemplary embodiments of the present invention, System 200 includes a first web 202, a second web 204, one or more rollers as represented by roller 228, one or more adhesive dispensing devices 230, folding devices 232, cutting devices 234 and optional additional fabric depositing devices represented by web 224. In exemplary embodiments, fabric depositing device 224 may deposit a strip of fabric at the hemline of back half 103 and front half 105 of T-shirt 114 to form a hemline seam. In some embodiments, adhesive 231 is deposited along the bottom perimeter of back half 105, front half 103 or both front half 105 and back half 103 prior to the fabric deposition by device 224. Therefore, as web 202 and web 204 moved forward past roller 228, joining back half 103 and front half 105 of T-shirt 114, a seam is formed at the T-shirt 114 hemline. In some embodiments, fabric pieces 225 supplied to form the hemline seam of T-shirt 114 are dispensed from a continuous web of fabric 224 (not shown here) and cutter 232 cuts each of the fabric pieces 225 to an appropriate length based on the T-shirt size. In some embodiments, fabric pieces 225 are precut and coupled to a web 224 that is operable to dispense fabric pieces 225 one piece at a time at the appropriate cadence to remain in synch with the movements of web 202 and 204, resulting in the fabric piece 225 to join the two parts of a garment to be formed at the desired location on the garment to form a seam, a pocket, a zipper, a logo, etc. In some embodiments, the the movement of web 202, web 204 and web 224 are continuous. In some embodiments, the movement of web 202, web 204 and web 224 follow a step movement. In some embodiments, one or more material web 224 may supply fabric pieces 225 to form a hemline, pockets, zippers and other ornamental or functional features. It should be understood that the fabric depositing devices may be located above web 202 and web 204, below web 202 and web 204, or some above one web and some below one web.

In some embodiments, folding tools or mechanisms 232 may be used to fold cut or uncut edges of one or more web 202 and web 204, before or after the deposition of adhesive on the article edges prior to folding and forming a seam. Folding tools and the formation of various types of seams will be further discussed in FIGS. 5 and 6. Note that the exemplary folding tools 232 of FIG. 2 are shown as operative in the X-Y plane. In alternative embodiments, folding mechanisms 232, adhesive dispensing mechanisms 230, and cutting mechanisms 234 are operable to cut, fold and create seams along any direction in the plane of the fabric or perpendicular to it. In some embodiments, some, or all folding tools 232, adhesive dispensers 230 and cutting tools 234 may be stationary. In some embodiments, some, or all folding tools 232, adhesive dispensers 230 and cutting tools 234 are mobile in one or more directions. Once the operations of adhesive dispensing, cutting and folding have been performed, rollers 228 or equivalent devices will join the two webs 202 and 204, each including part of the garment (as illustrated here each web includes either a front half or a back half of the garment) are brought together and pressure, steam, heat, lasers and other types of lights or radiation, and other operations are performed on the joined webs to activate and/or cure the applied adhesive 231 and permanently fuse the garment sections together. It should be understood that mechanisms other than rollers may be used to perform one or more operations designed to attach garment parts together depending on the type of fabric, the article design, the type of adhesive used and other manufacturing parameters. Cutting tools 236 may cut along the borders of the formed garment to detach the garment from the joined webs 202 and 204. The formed garment 114 may be collected in one stack while the joined web with the cutout 116 may be collected in a web 242 for disposal or additional processing. For example, the excess fabric remaining on the joined webs 202-204 may be used to create components for seams, pockets, belt loops, etc.

Figure 3:
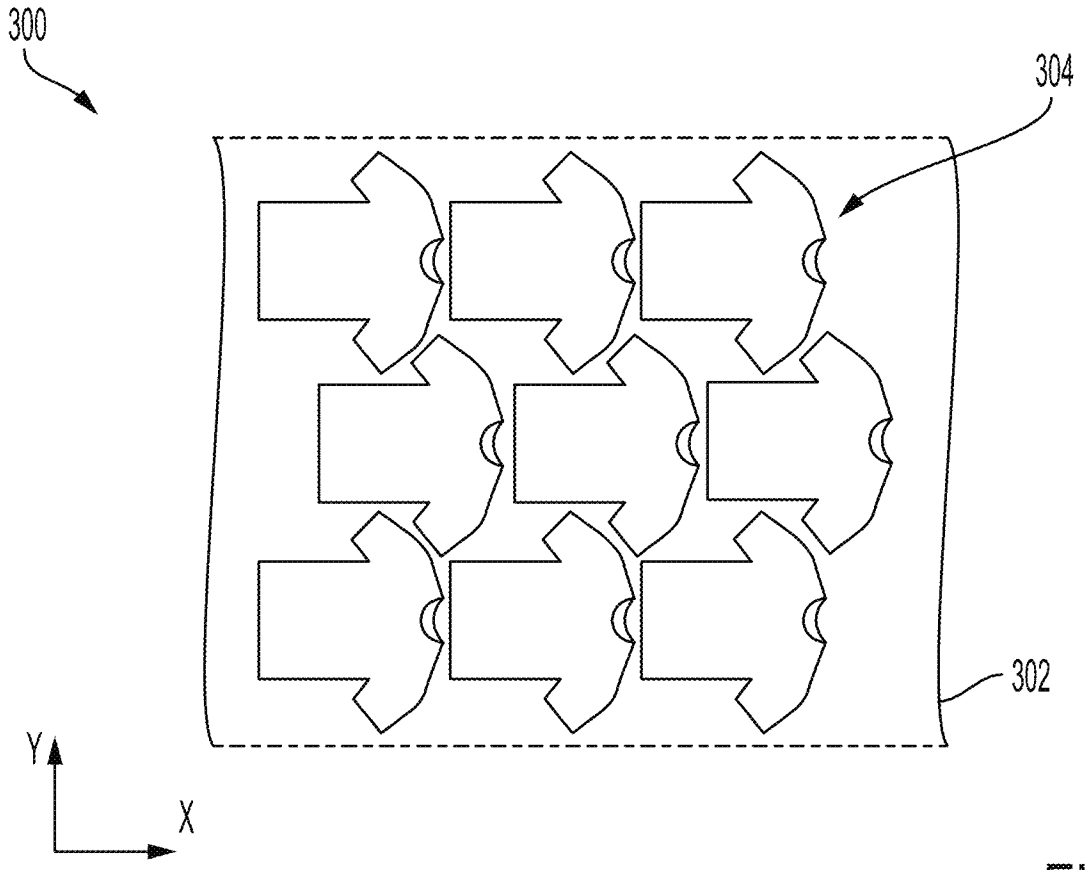
FIG. 3 illustrates alternative web layouts used in an automatic garment manufacturing system according to some exemplary embodiments of the present invention.

FIG. 3. illustrates alternative web layouts used in an automatic garment manufacturing system 300 according to some exemplary embodiments of the present disclosure. In some embodiments, efficient garment pattern is laid out in panel layout 304 on the web 302 may be used to optimize a variety of factors. In some embodiments, developing a garment pattern layout 304 the web 302 requires optimizing various parameters including reducing fabric material waste, simplifying the layout and ease of implementing manufacturing operations. In some embodiments, optimum garment panel layouts are configured using computers, software and artificial intelligence.

Figure 4:
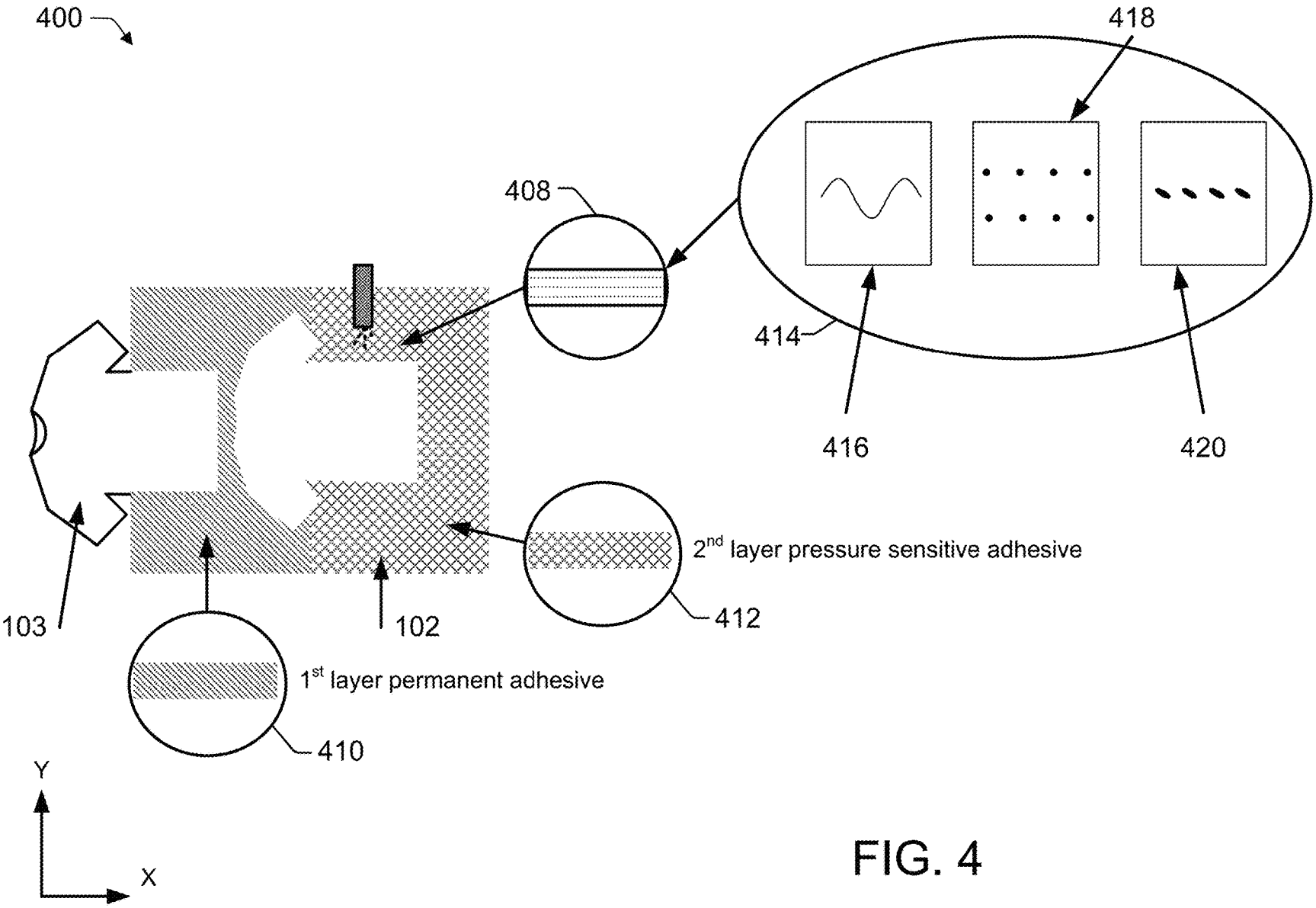
FIG. 4 illustrates methods of applying adhesive in an automatic garment manufacturing process according to some exemplary embodiments of the present invention.

FIG. 4. illustrates methods of applying adhesive in an automatic garment manufacturing process according to some exemplary embodiments of the present invention. In an exemplary system 400 of FIG. 4, adhesives are deposited along the borders of the back half 103 of T-shirt 114 while the back half 103 is still attached to the web 102. In exemplary embodiments, the adhesive may be applied in a solid, liquid, gel, or gaseous form. In some embodiments, the adhesive may be activated by heat, moisture in the air, pressure, lasers, lights or other forms of radiation, or a combination thereof. In some embodiments, the adhesive is applied to only one side of the garment, e.g. back half 103 in the illustrative example of FIG. 4. In some embodiments, adhesive may be applied to both sections of the garment 114, back half 103 and front half 105. In some embodiments, adhesive may be partially applied to each half of garment 114. In some embodiments, adhesive may be applied following different patterns for different sections of the garment 114 as the manufacturing requirements. In some embodiments, the perimeter for the application of adhesive to back half 103 (or front half 105 not shown in FIG. 4) may be defined to be larger or smaller than the actual size of the back half 103 (or front half 105 not shown in FIG. 4) of the garment. For example, the perimeter for the application of the adhesive to the back half 103 (or the front half 105) of the garment 114 may be larger than the boundaries of the back half of the garment 103 (or the front half 105). In that scenario, the subsequent cutting operation of the formed garment 114 may cut into the formed seam between the back half 103 and front half 105 of the garment 114 to achieve a desired functional or aesthetic property. In some embodiments, cutting into this border may be desirable to eliminate malformed seams or eliminate excess adhesive extrusions or bulging. In some embodiments, the garment border may be cut in such a manner to reduce the chances of garment fabric fraying. In some embodiments, the cutting process may be aided by heat to remelt the adhesive, the fabric or both at the newly cut joint to produce finished seams that are aesthetically pleasing, mechanically strong and durable or a combination of desired effects.

In some embodiments, the adhesion of back half 103 to the front half 105, or the adhesion of any other garment parts to another may be achieved using a laser. In some embodiments, a laser beam may be used to provide heat energy to activate one or more layers of adhesive acting to bind garment components. In some embodiments, garment parts made of synthetic fibers may be fused together directly using heat in any form such as a laser to melt the synthetic fibers of the garment parts.

In some embodiments, adhesives may be dispensed in a single layer. In some embodiments, adhesives may be dispensed in one or more layers. For example, a first layer 410 can be dispensed as a permanent adhesive and a second layer 412 can be dispensed as a pressure sensitive layer. In some embodiments, a single formulation or type of adhesive may be used for all layers. In alternative embodiments, different types of adhesives with different properties may be used for different layers. In the illustrative example of FIG. 4, a hot-melt polyurethane (HMPUR) adhesive known for its application to garment fabric is used. One of the properties of HMPUR is its ability to react with moisture present in the air to change chemically and create a strong bond between materials. This bond may then continue to strengthen over 24-96 hours until it is fully cured. As such, HMPUR is a good adhesive for use with many types of textile materials. The HMPUR may be dispensed through a hot melt dispensing spray gun that can create specific graphic patterns on demand to allow for predetermined coverage and placement of adhesive on fabric. Other adhesives with different chemistry such as those of polyester, polyamide and epoxy may also be used.

In some embodiments, the adhesive is applied using one or more patterns 414, each pattern designed to achieve different properties. In some embodiments, the adhesive may be applied in a non-linear pattern such as serpentine, zig zag or curvilinear 416 manner within a defined band or border, along the perimeter of the back half 103 or front half 105 of garment 114. In some embodiments, certain adhesive patterns may provide a greater degree of movement or stretchability at the joint in a particular direction while still retaining sufficient seam strength. In some embodiments, the adhesive may be applied in discrete non-continuous dots 418, non-contagious stripes or ellipsoids 420, and positioned at one or more angles with respect to the borders of the garment. In some embodiments, the application of a pattern of non-continuous adhesive may impart the necessary bonding strength while reducing the amount of adhesive consumed as compared to a pattern requiring the continuous application of adhesive to the same area.

Figure 5:
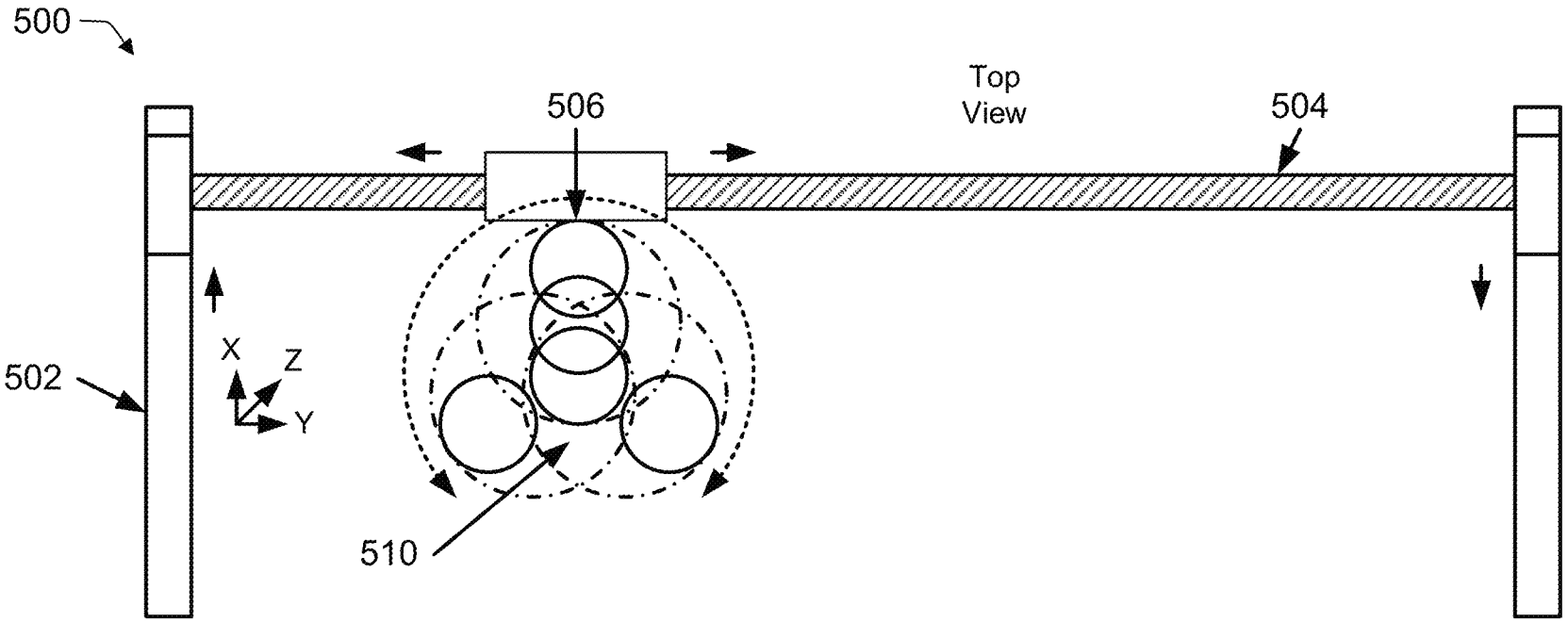
FIGS. 5 and 5A-5G illustrate exemplary systems for cutting, folding and seam formation according to some exemplary embodiments of the present invention.
Figure 5A:
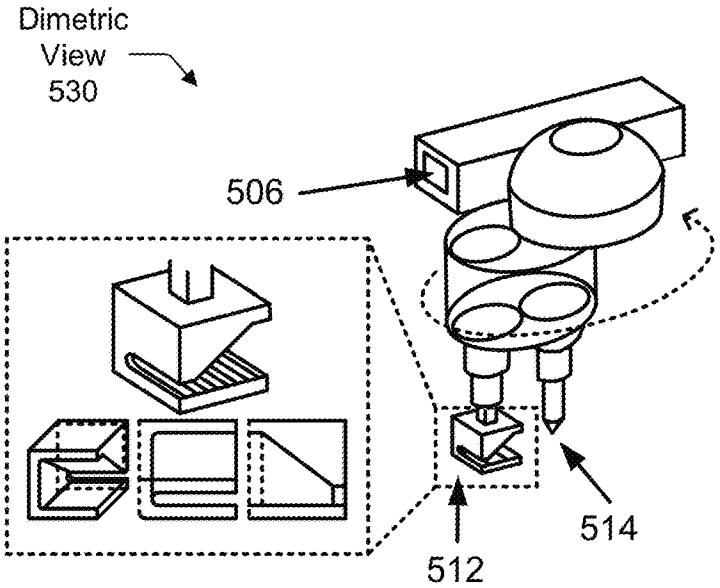
Figure 5B:
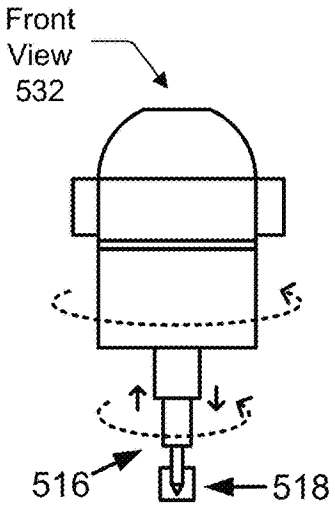
Figure 5C:
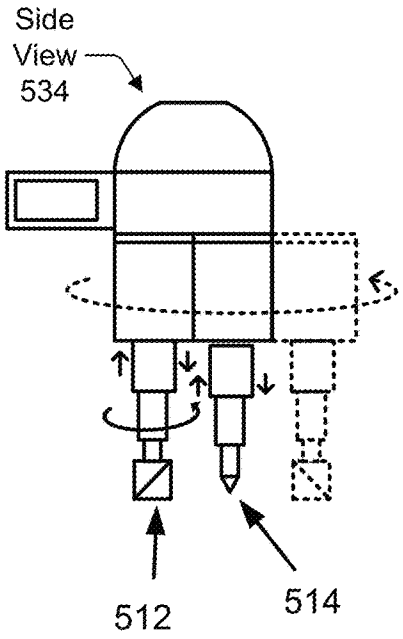
Figure 5D:
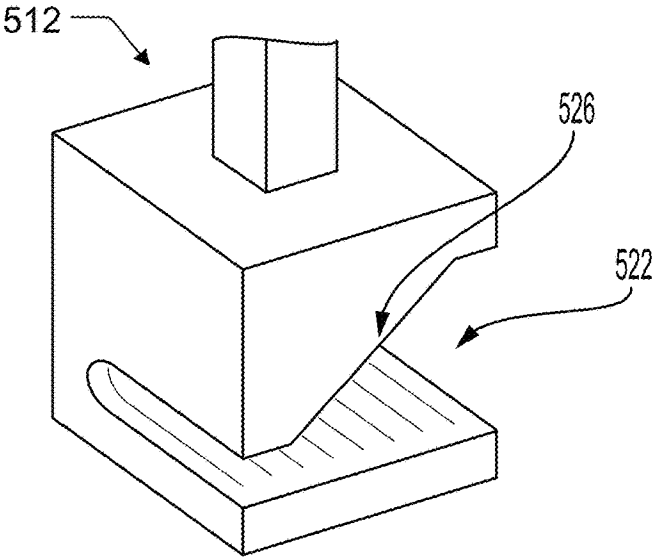
Figure 5E:
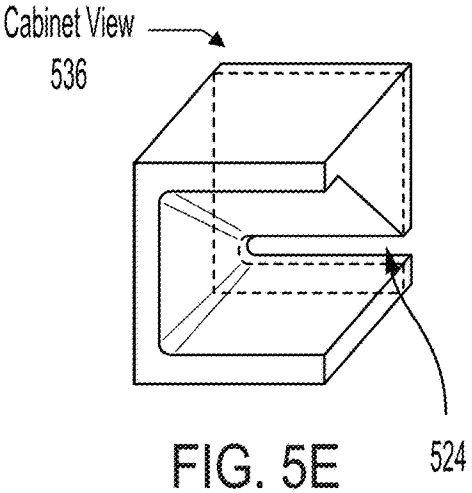
Figure 5F:
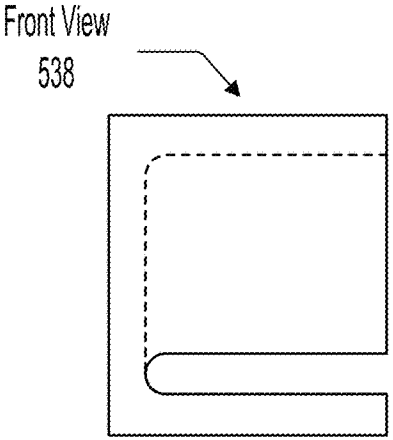
Figure 5G:
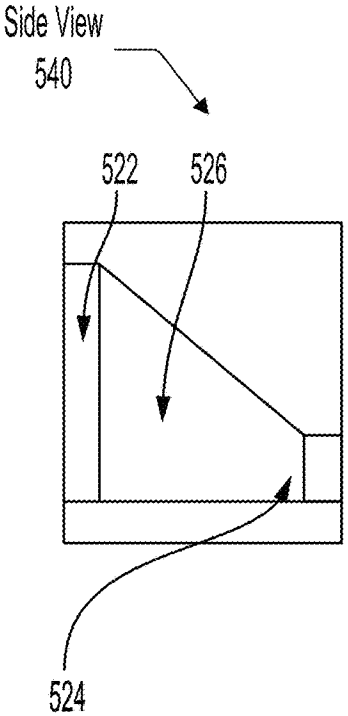

FIGS. 5 and 5A-5G illustrates exemplary systems for cutting, folding and seam formation according to some exemplary embodiments of the present invention. As shown in FIGS. 5 and 5A-C, in some embodiments, the cut and fold mechanism 500 includes tools, structures and components allowing one or more cut/fold head(s) 510 to move in three dimensions, along the length of the web, along the width of the web, and in a direction perpendicular to the web. In some embodiments, rails 502 provide cut/fold head 510 mobility in a direction along the length of the webs 102, 104 (parallel to the X-axis as shown in FIG. 5) or any other web. Similarly, rail 504 provides for movement in a direction along the width of the webs 102, 104 (along the Y-axis as shown in FIG. 5) or along one or more directions with respect other webs. In some embodiments, cut/fold head 510 may be operable to turn on an axis which may be at an angle or perpendicular to the plane of the webs 102 and 104. In some embodiments, cut/fold head 510 may include mechanisms that can retract or extend folding tool 512 or cutting tool 514, providing for movements perpendicular to the plane of the web 102, 104 or other webs (along the Z-axis, into and out of the page as shown in FIG. 5), to disable or enable the cutting and folding tools from engaging with the web. In some embodiments, the cut/fold head 510 includes actuators or motors that operable to actuate the cut/fold head 510 in three dimensions. In some embodiments, actuator 506 includes one or more step motors, continuous motors, or other types of actuators that move cut/fold head 510 along rail 504. In some embodiments, rail 504 is coupled to rails 502 in such a way to allow rail 504 to move back and forth along the length of rails 502, providing for the cut/fold head 510 to travel along the length of webs 102 and 104 (X-axis) in addition to travels along the width of webs 102, 104 (Y-axis) or travel in the plane of other webs.

In some embodiments, cut/fold head 510 includes a folding tool 512 (also referred to as the folding head or folding mechanism) and a cutting tool 514, shown in diametric view 530 and side view 534. As shown in FIGS. 5D-5G illustrating a cabinet view 536, a front view 538, and a side view 540 of the folding tool 512, in some embodiments, the folding tool 512 may include actuators that can extend or retract the folding tool 512 along an axis 516 (Z-axis) perpendicular to the plane of web 102, 104 or other webs. In some embodiments, the folding tool 512 includes gears, motors or other types of actuators that allow the folding tool 512 to rotate about an axis 518 (parallel to the Z-axis), providing finer movements of the folding tool 512, as shown in front view 532. As shown in FIGS. 5D-5G, in some embodiments, the folding tool 512 may include an entry face 522 with a greater area or height, an exit face 524 with a smaller area or height, and a gradually narrowing channel 526 connecting the two faces 522 and 524. This design is operable to fold fabric edges as the folding tool 512 travels along a given path. As shown in FIGS. 5 and 5A-C, the folding tool 512 may move along any direction in three dimensions allowing the formation of seams corresponding to a variety of shapes and designs. In some embodiments, one or more folding tool 512 may be affixed to and stationary with respect to the garment manufacturing system but operable to allow webs 102 and 104 (or other webs not shown) to travel through the stationary folding tool. In the example of a fix folding tool 512, as a web 102 or 104 travels through a folding tool 512, it operates on the web and folds the fabric to form a fold and/or a scam. In some embodiments, folding tool 512 may include one or more apparatuses (not shown) such as rollers or plates operable to provide pressure and/or heat to enhance and/or maintain the folded edge of the web fabric 102 or 104, or to activate and cure any adhesives applied to form a seam. In some embodiments, one or more fixed folding tool 512 may operate alongside one or more mobile folding tools 512 to fold edges of web 102, web 104 or other webs, as the web in one or more directions. Fixed folding tools may be easier to implement but mobile folding tools provide greater flexibility. A non-stationary or mobile folding tool 512 as shown in FIGS. 5 and 5A-G that is operable to move in any direction in three dimensions and rotating in clockwise or counterclockwise directions up to 360 degrees with respect to a web would provide greater versatility to creating more complicated designs. In some embodiments, the cut/fold head 510 may include one or more folding tools 512, each including different physical or operational characteristics.

In some embodiments, the cut/fold head 510 includes a cutting tool 514. In some embodiments, each cut/fold head 510 may include a single tool such as a cutting tool 514 or a folding tool 512. In some embodiments, the cut/fold head 510 may include a cutting tool 514 and a folding tool 512 on the same tool head. In some embodiments, each cut/fold head 510 may include one or more cutting tools 514 and/or folding tools 512 based on the manufacturing processes and the garment design requirements. In some embodiments, the cutting tool 514 may be a mechanical cutter such as a knife, a blade, a scissor or needles. In some embodiments, the cutting operation is performed by needles that may perforate the borders of the garment 114 while leaving the garment 114 attached to the web until further processing completes the separation of the garment 114 from the joined webs 102 and 104. In some embodiments, the cutting tool 514 may use a laser cutter or other non-mechanical cutting devices. In some embodiments, the cut/fold head 510 may include one or more cutting tools 514, each including different physical or operational characteristics. In some embodiments, the cutting tool 514 may be extended or retracted along an axis (Z-axis) perpendicular to the plane of the web 102, 104 or other webs. In some embodiments, the cutting tool 514 may operate in a fixed direction with respect to the direction of travel of a web and thus operable to cut the fabric in a fixed direction. In some embodiments the cutting tool 514 may travel along any path as defined by combinations of X, Y coordinates and rotate in clockwise or counterclockwise directions up to 360 degrees with respect to the web. The ability to rotate may be required of a mechanical cutter to produce non-linear seams. The same limitation may not apply to non-mechanical cutters such as a laser cutter. In some embodiments, a cutting tool 514 is in a static position in front of the folding tool 512 with respect to the direction of motion. In some embodiments, the cutting tool 514 and folding tool's 512 positions with respect to each other are adjustable prior to the start of the manufacturing operations and/or dynamically during the manufacturing operations. In some embodiments, the cutting tool 514 cuts the web fabric 102, 104 and other fabric webs per the garment design specifications. In some embodiments, as the cutting tool 514 cuts the web according to the design specifications, the folding tool 512 may engage in folding the cut sections of the fabric into a desired fold or seam shape. In some embodiments, seams are formed after applying adhesive, folding and/or cutting web material per a given design specification that dictates the sequence and coordinates for the application of each adhesive, fold and cut operation. Various seam shapes may be achieved using the cut/fold system and method described in this disclosure. Exemplary seam formations are further described below in FIGS. 6A-6C. In some embodiments, fixed or mobile folding head 514 may fold fabric and form a seam by applying adhesive to the fold prior to the folding operation, with or without the need to engage the cutting tool 514 to cut any fabric. As described herein, cutting tool 514, folding tool 512 and adhesive application tools 106 (FIG. 1) can move in three dimensions allowing for the formation of complex shapes that may be required by some article designs. However, in some embodiments, the cutting tool 514, folding tool 512 and adhesive application tools 106 may be stationary along one or more directions. In some embodiments, a combination of stationary and mobile cutting tools 514, folding tools 512 and adhesive application tools 106 may be used. In some embodiments, the folding tool 512 may include additional tools to apply pressure and/or heat to enhance or maintain the folded edge in shape after the fabric is folded by the folding tool 512. In some embodiments, the folding tool 512 is located close to rollers 228 (FIG. 2) (e.g. 10 mm to 100 mm). In some embodiments, the proximity of the folding tool 512 to the rollers 228 enhances the maintenance of the shape of the fold fabric because the folded fabric is kept taut under the tension in the web as it passes over the rollers 228 that changes the web's travel direction.

Figure 6A:
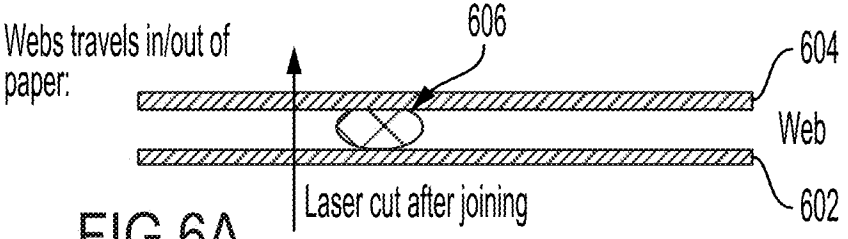
FIGS. 6A, 6B and 6C illustrate exemplary methods of seam formation as used in an automatic garment manufacturing process according to some exemplary embodiments of the present invention.
Figure 6B:
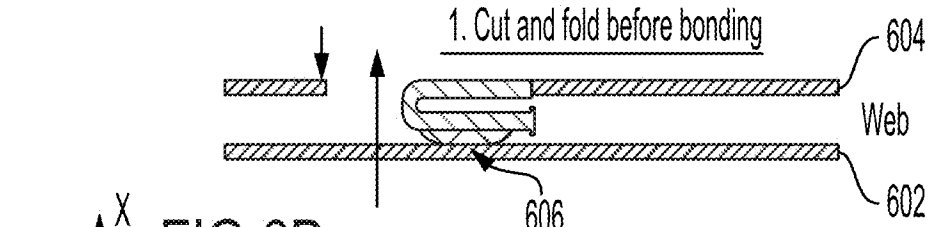
Figure 6C:
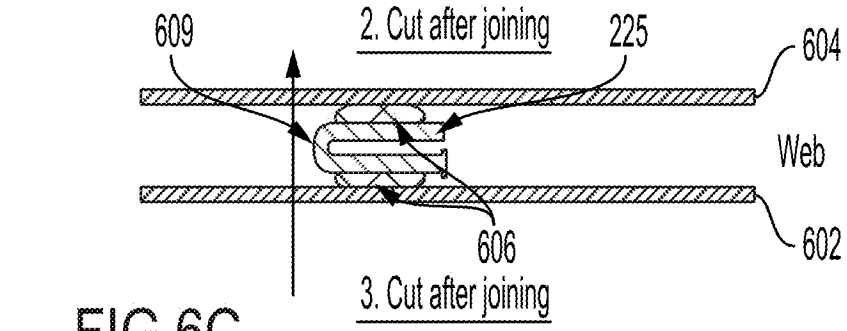

FIGS. 6A, 6B and 6C illustrate exemplary methods of seam formation as used in an automatic garment manufacturing process according to some exemplary embodiments of the present invention. FIG. 6A illustrates the formation of a simple peel seam or superimposed seam. As seen from FIG. 6A, the peel seam is formed by the application of adhesive 606 in-between web layer 602 and web layer 604 in a face-to-face configuration. After the formation of a bond between the two webs, excessive fabric is cut away from outside the bondline, the edge of the bondline or at some distance into the bondline, providing a finished and aesthetically acceptable simple peel seam. The peel seam of FIG. 6A is relatively simple to fabricate because it does not require cutting or folding of the fabric before joining the two edges of web layer 602 and web layer 604. However, the peel joint may have relatively low strength against forces that are applied perpendicular to the joint resulting in the joint coming apart or "peeling."

FIG. 6B illustrates the formation of a simple lap seam. As seen from FIG. 6B, the simple lap seam is formed by the application of adhesive 606 between web layer 602 and web layer 604 in a face to back configuration. The simple lap seam of FIG. 6B is formed by first cutting and folding web layer 604 so as to have its outer face facing and adhesively joined to the inner face of the lower web layer 602. After a bond formation step, the excessive fabric in web 602 may be cut to form a finished simple lap seam. The simple lap seam of FIG. 6B provides a higher strength against forces that are applied perpendicular to the joint.

FIG. 6C illustrates the formation of a double lap seam. As seen from FIG. 6C, the double lap seam is formed by the application of a piece of fabric 225 (as shown in FIG. 2) partially or completely coated with adhesive 606 on one side 609 between web layer 602 and web layer 604. After bond formation, excessive fabric on web 602 and web 604 may be cut to form a finished double lap seam. Double lap seams as shown in embodiments of FIG. 6C provides a higher strength against forces that are applied perpendicular to the joint. An advantage of a double lap seam may be aesthetics because a double lap seam may provide a cleaner looking finished seam on a garment.

It would be apparent to one skilled in the art that the above bonded seam types are illustrative examples only. A variety of bonded seams may be formed using the cutting, folding, inserting processes described in this disclosure. It would be apparent to one skilled in the art that one or more types of bonded seams may be required by the design or manufacturing specifications of a particular garment, in addition to limitations and requirements imposed by the nature of the fabrics and adhesives, aesthetic, endurance, sealing or permeability requirements of individual seams.

Figure 7A:
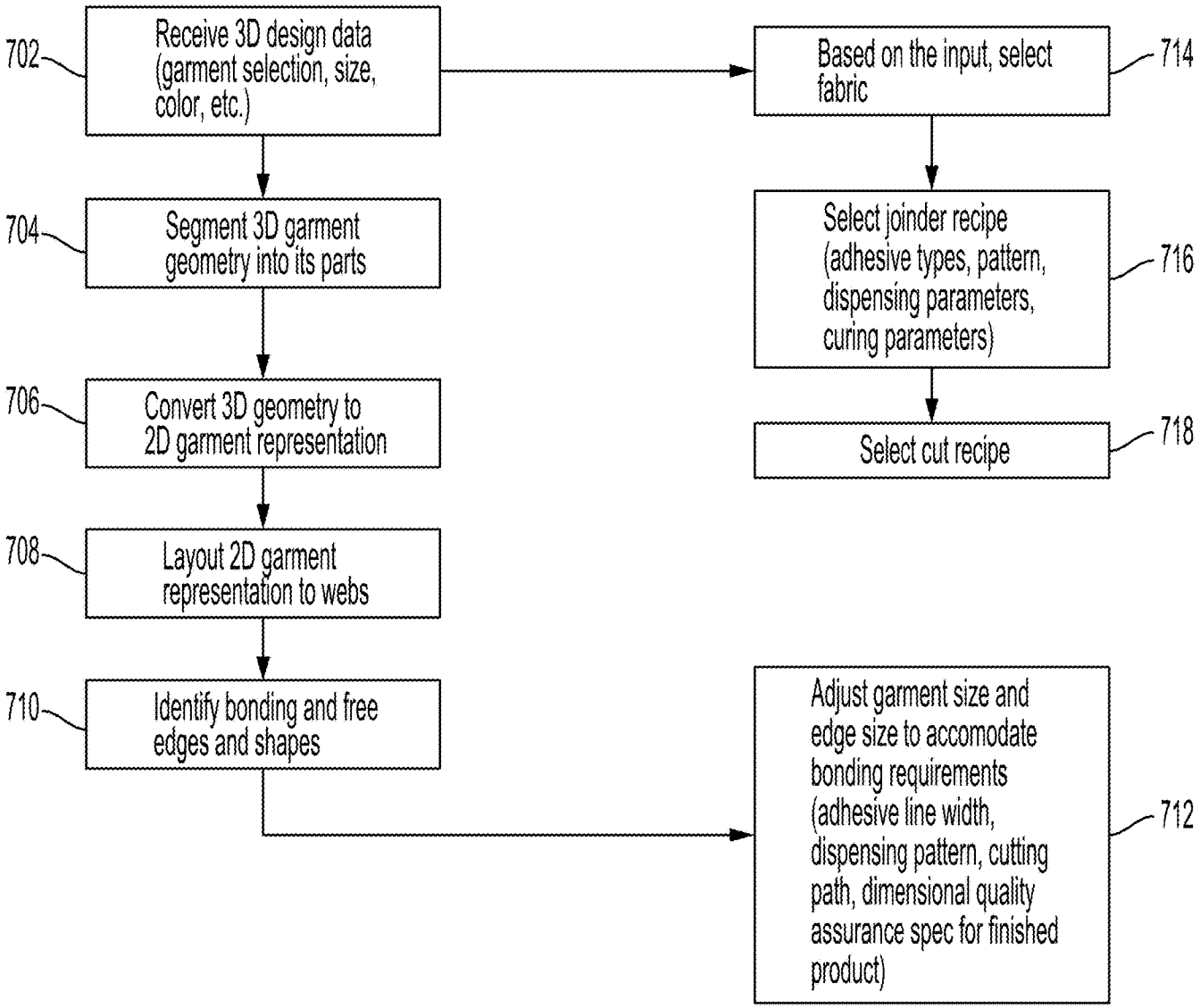
FIG. 7A illustrates an exemplary flow chart for processing design data used in an automated garment manufacturing process according to some embodiments.

FIG. 7A. illustrates an exemplary flow chart for processing design data used in an automated garment manufacturing process according to some embodiments. As seen in FIG. 7A, an exemplary automated garment manufacturing process using adhesive may start with the operation 702 of receiving garment manufacturing design data including the selection of a garment style, selection of colors, the types of accessories such as pockets and zippers that are required, personalization choices such as a logo created using various garment printing processes, embroidery or other embellishment using other accessories. Additional design data may include 3-D measurements, dimensions and sizes of the particular garment and other particulars of the article as measured in three dimensions, for example by a specialized scanners. In operation 702, based on the 3D design data received, the garment type is selected (e.g. a T-shirt, long sleeve shirt or a jacket). Similarly, based on the received design data, fabric is selected and the size of the garment is determined. The size of a garment may be based on actual 3D measurements in the case of custom fit garments or based on a ready-to-wear size chart. In the case of a custom fit garment, the measurements of the various parts of the garment are determined directly from actual measurements obtained either by a scanner or a manual measuring. In the case of a ready-to-wear garment, dimensions of the various garment parts such as the length, width and girth of the body of the garment, the sleeves, the neckline, etc. may be derived from the size of the garment derived from a generalized size to dimension correspondence table.

In operation 704, the three-dimensional garment design data are converted into the dimensions of individual components of the garment to be manufactured. The garment dimensions may include length and width of the body, the sleeves, the neckline, etc. of the garment. Based on the type of the fabric selected, the garment component dimensions may be adjusted to account for fabric properties such as stretch.

In operation 706, the 3D geometries of the garment components are converted to a 2-D representation. In operation 708, the two-dimensional representations of the garment are mapped or laid out onto one or more fabric webs. In some embodiments, the pattern of mapping garment components on one or more fabric web is laid out in panels in such a way to simplify fabrication, minimize material waste, or both.

In operation 710, based on the dimensions of the laid-out garment, the type of fabric or the aesthetic design of the garment, the bonding edges, shapes and the free edges of the garment are identified. The layout of the garment on the fabric web may include the steps of selecting which garment component panels are to be laid-out on which web, (e.g. right, left, upper or lower web). Additionally, considerations for the layout of the garment panels may include laying out the garment pieces inside-out or outside-in, headfirst or bottom first, etc.

In operation 712, the garment layout dimensions may be adjusted to accommodate the appropriate bonding border requirements including adhesive line width, adhesive dispensing pattern, cutting path and dimensional quality assurance specification for the finish garment.

In a parallel process flow path, in operation 714, based on the received 3D garment design data, the automated garment manufacturing system 100 may select the corresponding fabric web and load each fabric web in preparation for the start of manufacturing. In some embodiments, the selection and loading and preparation of the fabric web may be performed manually, semi-manually or automatically. In some embodiments, some or most of the material handling operations required at this step may be done automatically, for example using robots and cobots.

In operation 716, based on the garment design data, a joinder recipe is selected which determines the adhesive type to be used, the adhesive patterns (straight, zigzag, serpentine) and the adhesive curing parameters.

Finally, in operation 718 the cutting recipe is determined based on garment design data. For example, a particular cutting recipe may be used to minimize material waste or achieve a certain aesthetic design requirement.

Figure 7B:
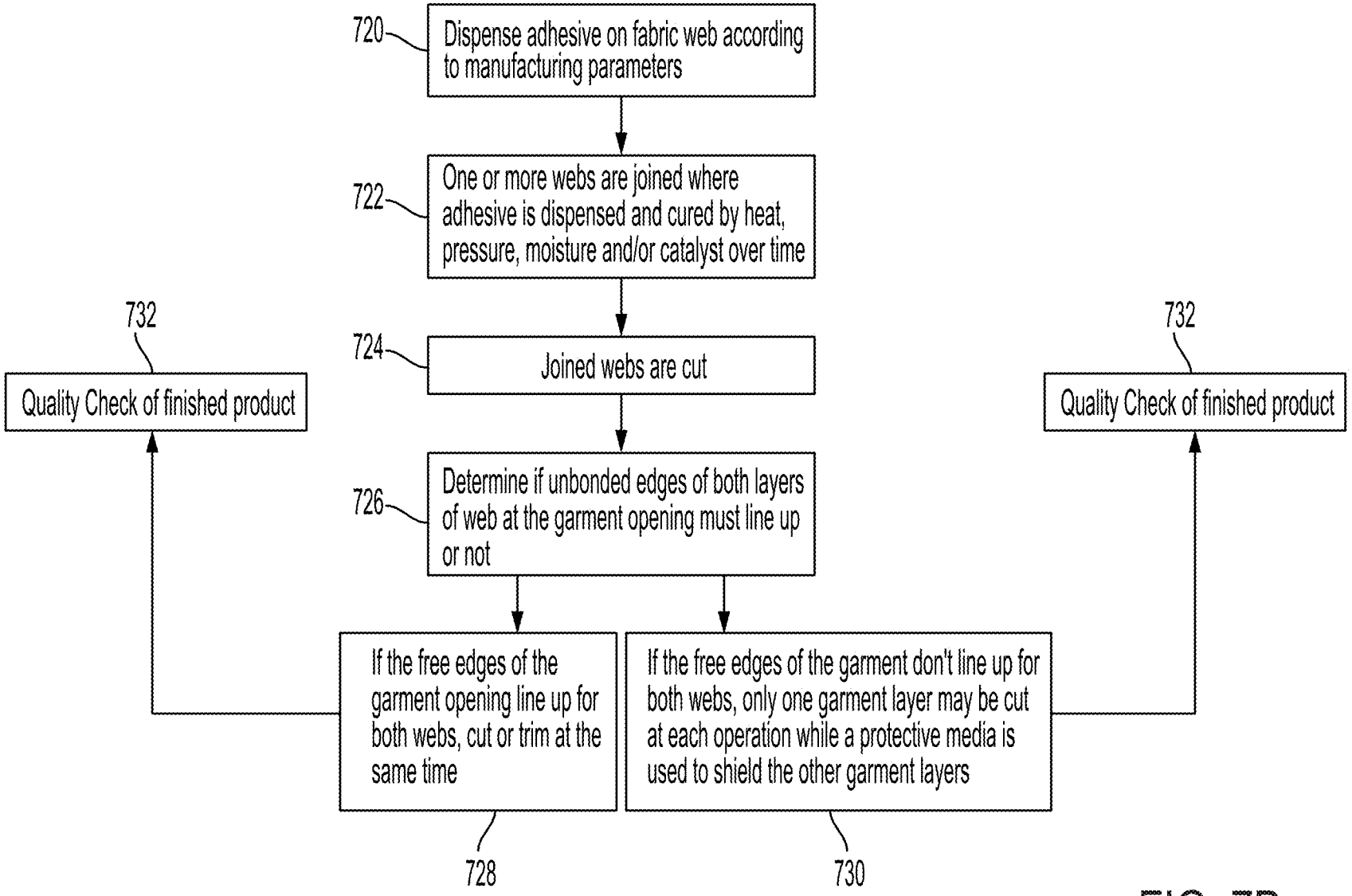
FIG. 7B illustrates an exemplary flow chart for cutting and joinder processes used in an automated garment manufacturing process according to some embodiments.

FIG. 7B. illustrates an exemplary flow chart for cutting and joinder processes used in an automated garment manufacturing process according to some embodiments. The operations detailed in FIG. 7B are generally directed to forming edges and seams for a garment in an automated fashion.

In operation 720, adhesive is applied to on one or more moving fabric webs per the manufacturing recipe created in operation 716. In operation 722, one or more webs are joined at least along areas where adhesive has been applied. Heat, pressure, moisture, radiation and/or catalysts may be applied for a given period of time (as per the manufacturing recipe) to the joined areas to activate and cure the bond between the joined web regions. Each of the parameters used to create a joint may be individually tuned and adjusted to achieve the optimum bonded joint based on the garment type, the joint type, dimensions, type of adhesive, whether the joint must be waterproof or not, and the aesthetics of the joint.

In operation 724, the joined regions that are formed by bonding one or more web areas together are cut on the outside perimeter of the joint, along the edge of the joint or at some distance within the joint. In some embodiments, the cutting along the joints may be complete along the entire garment perimeter, in which case the garment is hereafter fully detached from the webs. In some embodiments, the cutting operation may be limited to specific boundaries of the garment that may include bonded edges and free edges where no adhesive has been applied. In some embodiments the cutting operation may achieve both a functional and an aesthetic function. In some embodiments, the cutting operation may be limited to certain areas of the garment perimeter and the garment remains attached to the fabric webs until further processing. In some embodiments, the cutting is performed using needles to perforate the web but not to completely detach the garment from the web. In some embodiments, the final detachment of the garment from the web may be performed at a later stage in the garment manufacturing.

In some embodiments, in operation 726, based on the garment design data and the corresponding manufacturing requirements, the system determines whether each layer of a garment part with unbonded free edges (e.g., sleeve holes, neck hole) must align to each other or not. For example, for increased comfort wear, some T-shirt designs may require the layer of fabric layer forming the back of the neck section to be longer (taller as measured from the T-shirt hemline) than the front layer of fabric comprising the neck hole.

In some embodiments, in operation 728, if the garment design data requires the open edges of the garment in some area to be aligned between the two webs, then a single cutting operation may be performed on both layers of the garment. For example, both the lower and upper layers of fabric forming the sleeve hole may be cut in a single cut operation.

In some embodiments, in operation 730, if the garment design data requires the opening fabric edges not to align (e.g., the fabric layer of the back of neck hole must be longer than the fabric layer at the front of the neck hole), for each cutting operation, one fabric layer may be cut while the other fabric layers may be protected by an insert between the cutter and the other layers of fabric. For example, in the case of some T-shirt necklines, the edge of the back layer of fabric for the neck hole must be higher than the edge of the front layer of fabric for the neck hole. In such cases, the cutting operation may be performed in separate steps, using one or more cutters to cut a given fabric layer while protecting other fabric layers using a protective insert.

In operation 732, a quality inspection of the finished garment may be performed. In some embodiments, the quality inspection may be performed by human operators through a visual inspection. In some embodiments, a quality inspection may be performed using cameras using artificial intelligence. In some embodiments, the quality inspection may be performed while the finished garment is still attached to the web to simplify any material handling issues.

Figure 8:
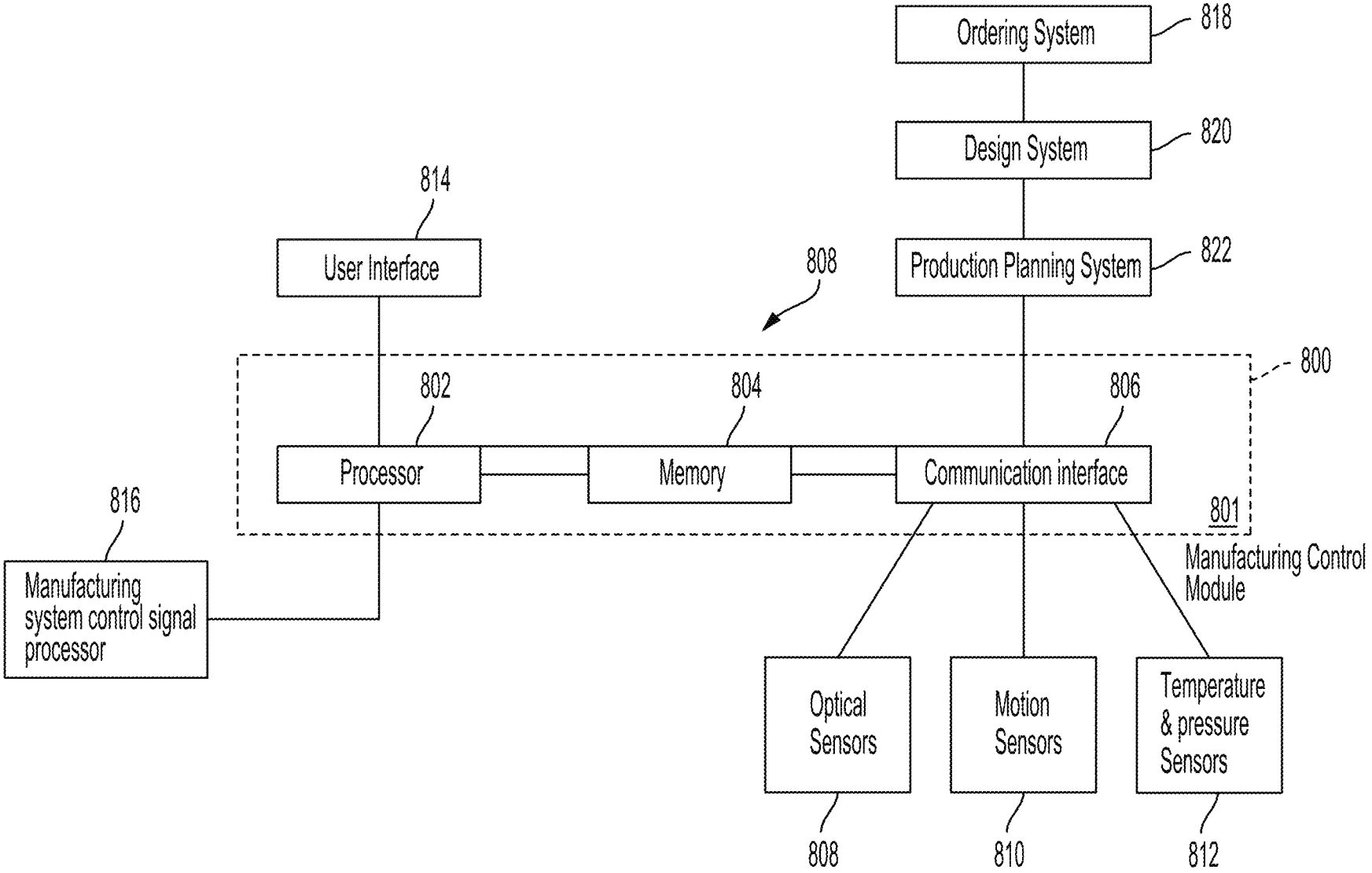
FIG. 8 illustrates an exemplary block diagram of a control system for an automatic garment manufacturing system according to exemplary embodiments of the present invention.

FIG. 8. illustrates an exemplary block diagram of a control system for an automatic garment manufacturing system according to exemplary embodiments of the present invention.

In some embodiments, the illustrative control system 800 includes a manufacturing control module 801 coupled to various components including one or more ordering system 818, one or more design systems 820, one or more production planning systems 822, one or more user interface devices 814, and one or more manufacturing system and control signal processor 816. In some embodiments, the manufacturing control module 801 may include one or more processors 802 coupled to memory modules 804 and one or more communication interfaces 806 to provide means for communicating with various automated garment manufacturing system inputs including one or more optical sensors and/or cameras 808, motion sensors 810 and temperature and pressure sensors 812. In various embodiments, various other types of sensors, not shown here, may provide relevant manufacturing parameters such as the level of moisture present in the factory air, viscosity of adhesive liquid, etc. Additionally, the manufacturing control module may include one or more power sub-systems and power backup systems not shown here.

The manufacturing control module 801 may be implemented at least partially in one or more computers, embedded systems, terminals, control stations, handheld devices, modules, any other suitable interface devices, or any combination thereof. In some embodiments, the components of manufacturing control system 801 may be communicatively coupled via one or more communications buses not shown here.

Processing equipment 802 may include a processor (e.g., a central processing unit), cache, random access memory (RAM), read only memory (ROM), any other suitable components, or any combination thereof that may process information regarding the automated garment manufacturing system 100. Memory 804 may include any suitable volatile or non-volatile memory that may include, for example, random access memory (RAM), read only memory (ROM), flash memory, a hard disk, any other suitable memory, or any combination thereof. Information stored in memory 804 may be accessible by processing equipment 802 via communications bus not shown. For example, computer readable program instructions (e.g., for implementing the techniques disclosed herein) stored in memory 804 may be accessed and executed by processing equipment 802. In some embodiments, memory 804 includes a non-transitory computer readable medium for storing computer executable instructions that cause processing equipment 802 (e.g., processing equipment of a suitable computing system), to carry out a method for controlling the automated garment manufacturing systems and processes. For example, memory 804 may include computer executable instructions for implementing any of the control techniques described herein.

In some embodiments, communications interface 806 includes a wired connection (e.g., using IEEE 802.3 ethernet, or universal serial bus interface protocols), wireless coupling (e.g., using IEEE 802.11 "Wi-Fi," Bluetooth, or via cellular network), optical coupling, inductive coupling, any other suitable coupling, or any combination thereof, for communicating with one or more systems external to manufacturing control module 801. For example, communications interface 806 may include a USB port configured to accept a flash memory drive. In a further example, communications interface 806 may include an Ethernet port configured to allow communication with one or more devices, networks, or both. In a further example, communications interface 806 may include a transceiver configured to communicate using 4G standards over a cellular network.

In some embodiments, user interface 814 includes a wired connection (e.g., using IEEE 802.3 ethernet, or universal serial bus interface, tip-ring-seal RCA type connection), wireless coupling (e.g., using IEEE 802.11 "Wi-Fi," Infrared, Bluetooth, or via cellular network), optical coupling, inductive coupling, any other suitable coupling, or any combination thereof, for communicating with one or more of user interface devices 814. User interface devices 814 may include a display, keyboard, mouse, audio device, any other suitable user interface devices, or any combination thereof. For example, a display may include a display screen such as, for example, a cathode ray tube screen, a liquid crystal display screen, a light emitting diode display screen, a plasma display screen, any other suitable display screen that may provide graphics, text, images or other visuals to a user, or any combination of screens thereof. Further, a display may include a touchscreen, which may provide tactile interaction with a user by, for example, offering one or more soft commands on a display screen. In a further example, user interface devices 814 may include a keyboard such as a QWERTY keyboard, a numeric keypad, any other suitable collection of hard command buttons, or any combination thereof. In a further example, user interface devices 814 may include a mouse or any other suitable pointing device that may control a cursor or icon on a graphical user interface displayed on a display screen. In a further example, user interface devices 814 may include an audio device such as a microphone, a speaker, headphones, any other suitable device for providing and/or receiving audio signals, or any combination thereof. In some embodiments, user interface 814, need not be included (e.g., control module 801 need not receive user input nor provide output to a user).

In some embodiments, a sensor interface (not shown) may be used to supply power to various sensors, a signal conditioner (not shown), a signal pre-processor (not shown) or any other suitable components, or any combination thereof. For example, a sensor interface may include one or more filters (e.g., analog and/or digital), an amplifier, a sampler, and an analog to digital converter for conditioning and pre-processing signals from sensor(s) 808, 810 and 812. In some embodiments, the sensor interface communicates with sensor(s) via communicative coupling which may be a wired connection (e.g., using IEEE 802.3 ethernet, or universal serial bus interface), wireless coupling (e.g., using IEEE 802.11 "Wi-Fi," or Bluetooth), optical coupling, inductive coupling, any other suitable coupling, or any combination thereof.

Sensor(s) 808, 810 and 812 may include any suitable type of sensor, which may be configured to sense any suitable property or aspect of automated garment manufacturing systems and processes 100, any other system, or any combination thereof. In some embodiments, sensor(s) 808, 810 and 812 include linear encoders, rotary encoders, or both, configured to sense relative positions, speed, temperature, pressure, etc. In some embodiments, sensor(s) includes various types of optical sensors 808 including cameras configured to capture images (e.g., time-lapse imaging) of various aspects of the operation of the automated garment manufacturing systems and processes. In some embodiments, temperature and pressure sensor(s) 812 include one or more temperature sensors such as, for example, a thermocouple, a thermistor, a resistance temperature detector (RTD), any other suitable sensor for detecting temperature, or any combination thereof. For example, sensor(s) 812 may include a thermocouple arranged to measure the temperature and/or viscosity of liquid adhesive to be applied to the webs.

Automated Hem Formation:

With the manual manufacture of items such as garments, bags etc. many of the fabrication operations have been performed after various portions of the item have been joined together, such as by seaming. For example, in the case of a shirt, various panels such as back front, sleaves etc. can first be joined together to form a three-dimensional item by manual operations of sewing by a skilled seamstress using tactile feedback to judge how fast and with what tension to feed under the sewing machine, as an example, two body panel fabrics to properly join them together and form the body of the garment. After the body panels have been joined together, other operations may be performed, such as the formation of hem seams at various openings such as neck holes, bottom openings, sleeve openings, etc. In addition, other fabrication operations such as the addition of pockets or ornamental items can be added. This can work in a manual fabrication environment where human operators manipulate and operate on garment components. However, the manipulation of garment components requires a great deal of skill and dexterity on the part of the human operator performing the operation. In an automated setting, such an order of operations becomes much more challenging. The manipulation of a soft, flexible, three-dimensional item such as a t-shirt by a robot or other tooling in an automated manufacturing environment presents significant challenges. Therefore, in an automated fabrication environment, performing as many operations as possible on a flat sheet of fabric makes automation much easier and much more reliable. For example, forming a hem seam on a flat section of fabric before joining two or more panels together, or installing a pocket or ornamental feature on a flat panel of fabric, greatly facilitates the accuracy and feasibility of an automated process. For purposes of the present description, a large or continuous roll or sheet of fabric will be referred to herein as a hem.

Figure 9:
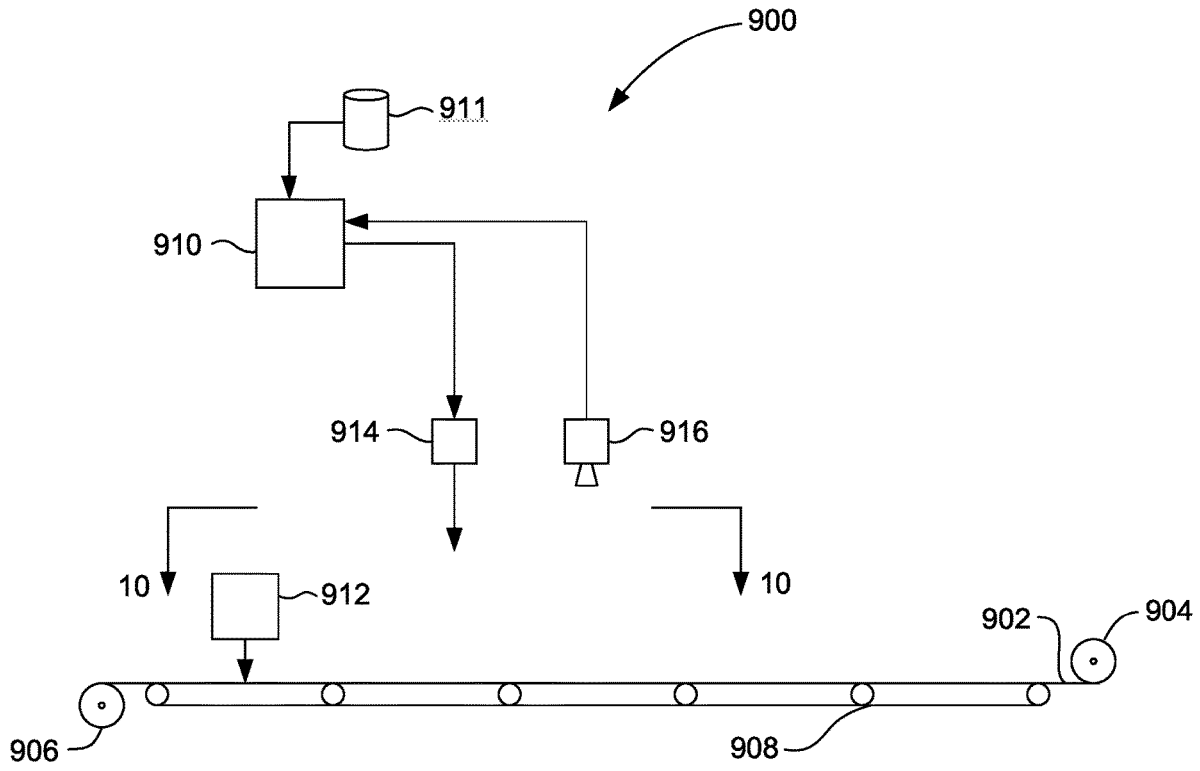
FIG. 9 is a side schematic view of a computer vision manufacturing system which might be implemented with one or more embodiments.

FIG. 9 shows a schematic illustration of a computer vision system 900 which may optionally be utilized in a hem formation process to be described herein below. In one embodiment, the computer vision system 900 can be implemented in a garment manufacturing process that can perform manufacturing operations on a web of fabric 902, which can be supplied and retrieved by rolls 904, 906, and which can be conveyed by exerting force directly on the fabric or indirectly by transporting the fabric on one or more conveyor belts 908.

The computer vision system 900 can include an operating system 910, that can include circuitry, software and computer memory, and which is operable to receive manufacturing data 911 and to deliver machine readable instructions to tooling 912. The tooling 912 can be, for example a cutting tool which can include one or more blades, scissors, saws, lasers, etc., that can be operable to cut one or more pieces out of one or more layers of fabric 902. The tooling 912 could also be some other type of tooling, such as tooling for joining two or more pieces of fabric by applying adhesive or stitching the fabric web pieces. The tooling 912 could also be robotic tooling for affixing one or more items to the fabric. The tooling 912 could also be embroidery tooling, printing tooling, silk screen tooling, etc. Possible embodiments of the tooling 912 will be further described in greater detail herein below.

The computer vision system 900 can include one or more projectors 914, and a vision component 916. The vision component 916 can be a video camera, still frame camera, spectrometer, or some other type of device capable of receiving visual information from the workpiece (e.g., fabric 902) and one or more images displayed by the one or more projectors 914*a*, 914*b*.

Figure 10:
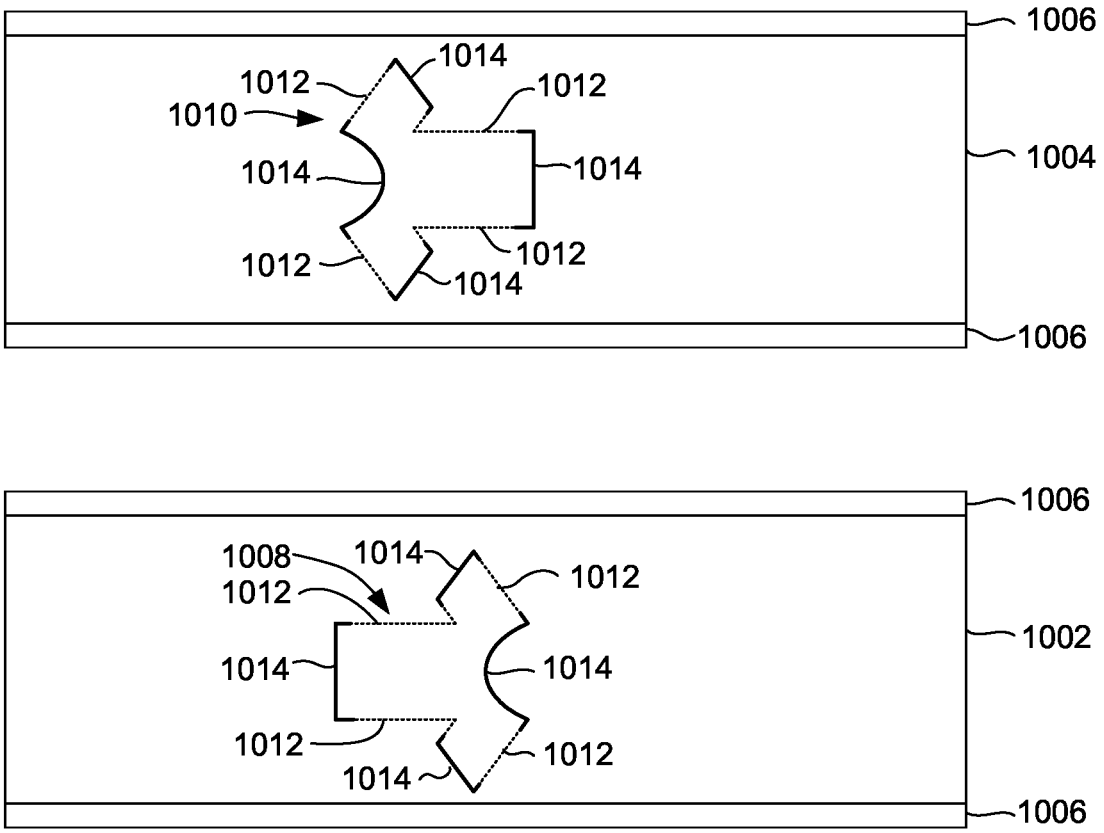
FIG. 10 is a top-down view material portions on which manufacturing processes can be performed.

FIG. 10 shows a top-down view of a material portions 1002, 1004. Each of the material portions 1002, 1004 may be formed as a continuous web of fabric that can be laid out on and supported by a flat surface 1006. Material portions 1002 and 1004 are layers of fabric that may be of any size and may accommodate one or more garment components on its surface. For clarity, in the exemplary embodiments below each fabric layer 1002 or 1004 is shown to accommodate a single garment panel, in this case a top panel 1004 and a bottom panel 1002. In alternative embodiments, each fabric layer 1002 and 1004 may include a plurality of garment panels to be used to form the garment and allow for less material waste. In the embodiment shown in FIG. 10, the fabric panels 1002, 1004 may be portions of a common continuous web of fabric or could be two or more separate continuous webs of fabric. Such embodiments have been previously described above with reference to FIGS. 1-9. In an exemplary embodiment the continuous webs of fabric 1002 or 1004 are suspended freely between one or more rollers, fabric rolls. In other embodiments, the material portions 1002 and 1004 may be laid on or supported by a flat surface 1006 comprised of backing material such as a chain link conveyor that allows for access to the material portions from below the flat surface 1006. The material portions 1002, 1004 can be a fabric, such as a fabric web and could be a fabric web supplied and retrieved from rolls 904, 906 as described above with reference to FIG. 9. The material portions 1002, 1004 could be a fabric, felt or could be any number of other types of flexible workpiece material such as natural or synthetic material such as leather, vinyl, upholstery, etc. Also, although the fabric portions 1002, 1004 are shown as two separate material portions, they could be made of a single or multiple types of material, fabric, leather, upholstery, etc. The surface 1006 can be one or more conveyor belts, such as the conveyor belt 908 described above with reference to FIG. 9 or configurations described above with reference to FIGS. 1 and 2. In alternative embodiments, the fabric web is conveyed directly via rollers, motors and other actuators that can pull the fabric and move it.

FIG. 10 also shows exemplary body panels 1008, 1010 to be formed into an exemplary T-shirt. In the present disclosure, the term "panel" refers to a portion of fabric that has been already cut from a bolt or piece of fabric to form a garment piece that can joined by seaming to another fabric piece. However, for purposes of the present disclosure, the term "panel" can also be used to refer to a pattern that has not yet been cut from a larger bolt or roll of fabric, but which can be later seamed and cut according to a process that facilitates automated manufacture. In exemplary embodiments, one or more manufacturing processes are applied to patterns or panels on a flat fabric portion still connected with a web of fabric because it allows for certain manufacturing processes to be more easily automated. Such automation would be impractical on a loose, pliable panel of fabric that has been already cut from a larger piece or web of fabric. In addition, the term "hem" is used herein to describe a portion of fabric that has been folded over and affixed to itself, whereas the term "seam" is used to describe the joining of one fabric piece to another fabric piece.

The dashed lines 1012 show the locations of future operations to be carried out to form the patterns or panels 1008, 1010, while the solid lines 1014 show the location where cutting operations will be performed to form a hem as shown below. In one exemplary embodiment, patterns/panels 1008 and 1010 may also be configured as body panels for a T-shirt. In exemplary embodiments, the dashed lines 1012 and the solid lines 1014 may be projections of a pattern from a projector 914 onto the fabric layers 1002 and 1004. as described above with reference to FIG. 9 according to one embodiment. In another embodiment, the solid lines 1014 could also represent a location where cutting, bonding and/or seaming operations will be performed either manually or through use of automated machines such as by computer numerical control or robotics, rather than being an actual projection. In alternative embodiments, the solid lines 1014 may represent both the locations where certain operations may be performed on the fabric layers 1002 and 1004 as well as the projections of a projector 914 onto a fabric layer 1002 and 1004. In exemplary embodiments, the computer vision system 900 may be operable to verify the accuracy of fabrication operations performed on fabric layers 1002 and 1004 by comparing the location and the trace of the operations to the projections of the computer vision system onto the fabric layers 1002 and 1004. In FIG. 10, the panels 1008, 1010 are shown as being front and back panels of a shirt such as a t-shirt. This is, however, by way of example, as the pattern could be for any number of other panel pieces of any number of products requiring hemming, such as, but not limited to pants, jackets, or other garments, hats, handbags, backpacks, other accessories, as well as pillow cases, bed sheets, towels, etc. In the embodiment shown in FIG. 10, the panels 1008, 1010 are shown as being flipped relative to one another. In order to join the patterns 1008, 1010 together to form a product (i.e., t-shirt) the one of the panels 1008, 1010 must be first flipped over to join with the other pattern. In one embodiment, the panels 1008, 1010 are laid out on the panels continuous web of fabric 1002/1004 inside out relative to a garment to be formed.

Figure 11:
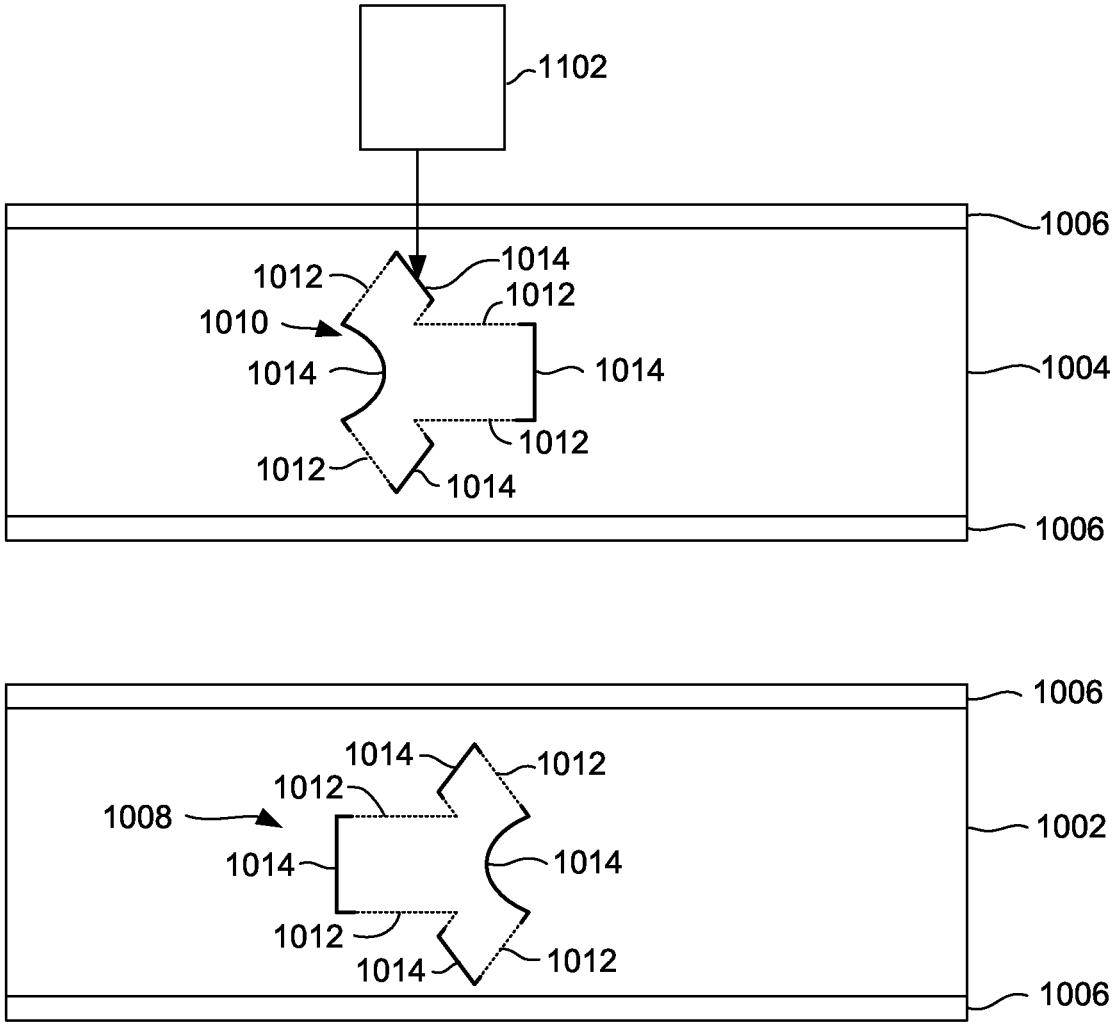
FIG. 11 is a top-down view of material portions having hem notch cuts formed thereon.

With reference to FIG. 11, tooling 1102 may be operable to make cuts along one or more hem lines to form notches 1014. In exemplary embodiments, the notches 1014 can be configured as a single cut along a transverse line, including a shallow cut at a proximal and distal end of the cut in a direction that is approximately 90 degrees from the transverse line. In some embodiments, the length and shape of the transverse line may be determined by the shape and size of the garment to be manufactured (e.g., size of a neck hole or sleave), whereas the dimensions of the shallow cuts at the distal ends of the transverse line may be determined by the desired depth of a hem to be formed. The tooling 1102 can be a manual cutting tooling, or in alternative embodiments, it could an automated tooling. The tooling 1102 may be one of various types of cutting tooling such as, but not limited to laser, scissor, knife, saw, etc. It should be pointed out, that the cuts 1014 on one pattern 1008, may not be the same as the cuts 1014 on the other pattern 1010. For example, in the example shown, where the patterns 1008, 1010 are front and back panels respectively of a t-shirt, the neckline of the front panel (e.g., 1008) could have a deeper and slightly different shaped curve than the neckline of the back panel (e.g., 1010) in order to trace the natural contours of the human body and ensure a proper fit. Again, it should also be pointed out that the illustration of t-shirt panels in FIG. 11 is by way of example, as many other types of garments or other items requiring hems could be contemplated.

Figure 12:
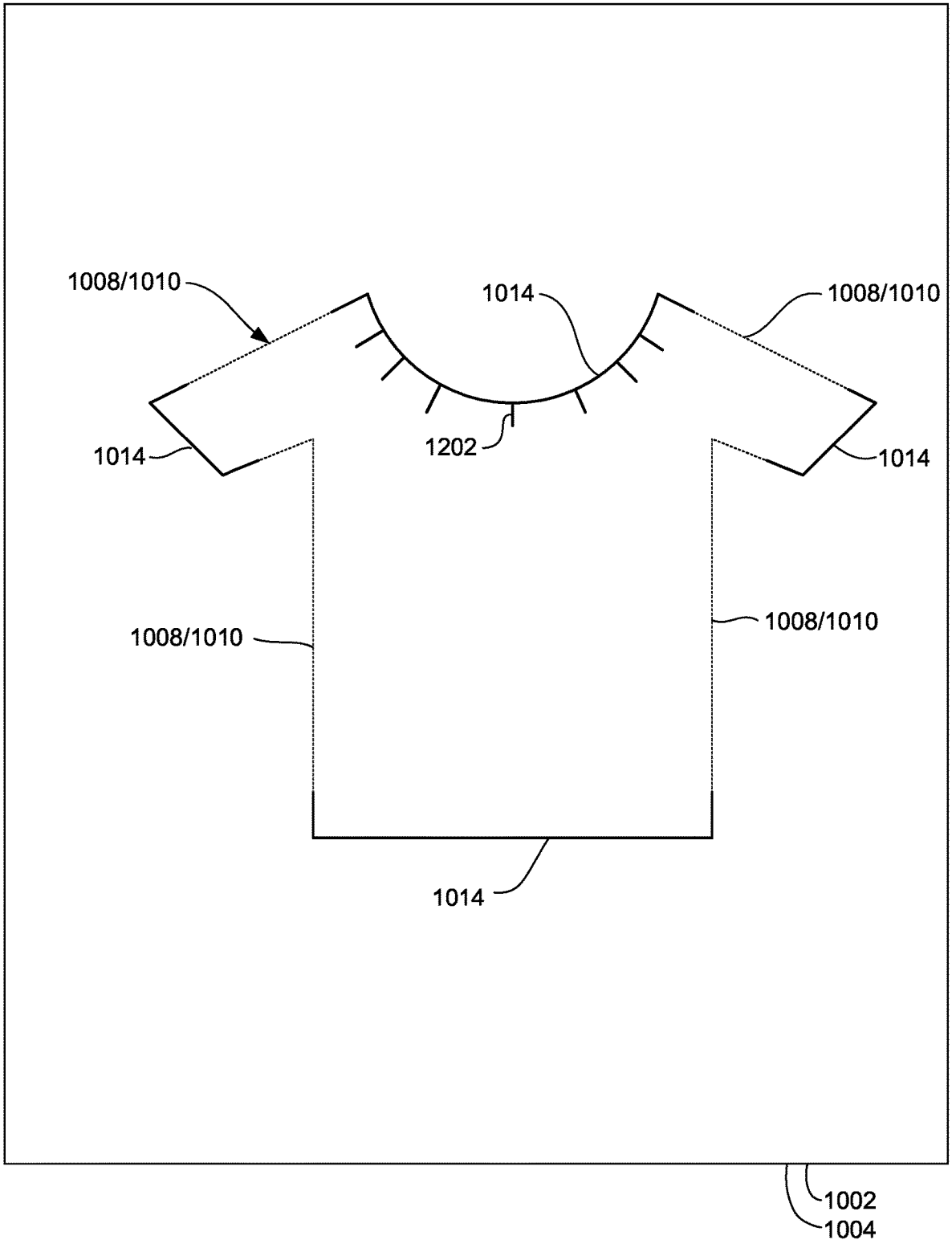
FIG. 12 is an enlarged view of a material portion having hem notch cuts formed thereon.

FIG. 12 shows an enlarged view of a pattern 1008 or 1010. As shown in FIG. 12, when a cut 1014 has a curved shape, such as for a neckline, slits 1202 may be cut into and along the curve of the cut 1014 to allow for proper folding along the curved line as will be seen. The slits 1202 can be straight as shown or could be "V" shaped, depending upon the application. Generally speaking, if the hem cut 1014 is concave the slits 1202 can be straight, whereas if the hem cut 1014 is convex the slits 1202 can be "V" shaped. In some embodiments the slits 1202 can be generally 90 degrees relative to the transverse line. In other embodiments, the slits 1202 may form more acute angles relative to the cut 1014 transverse line.

Figure 13:
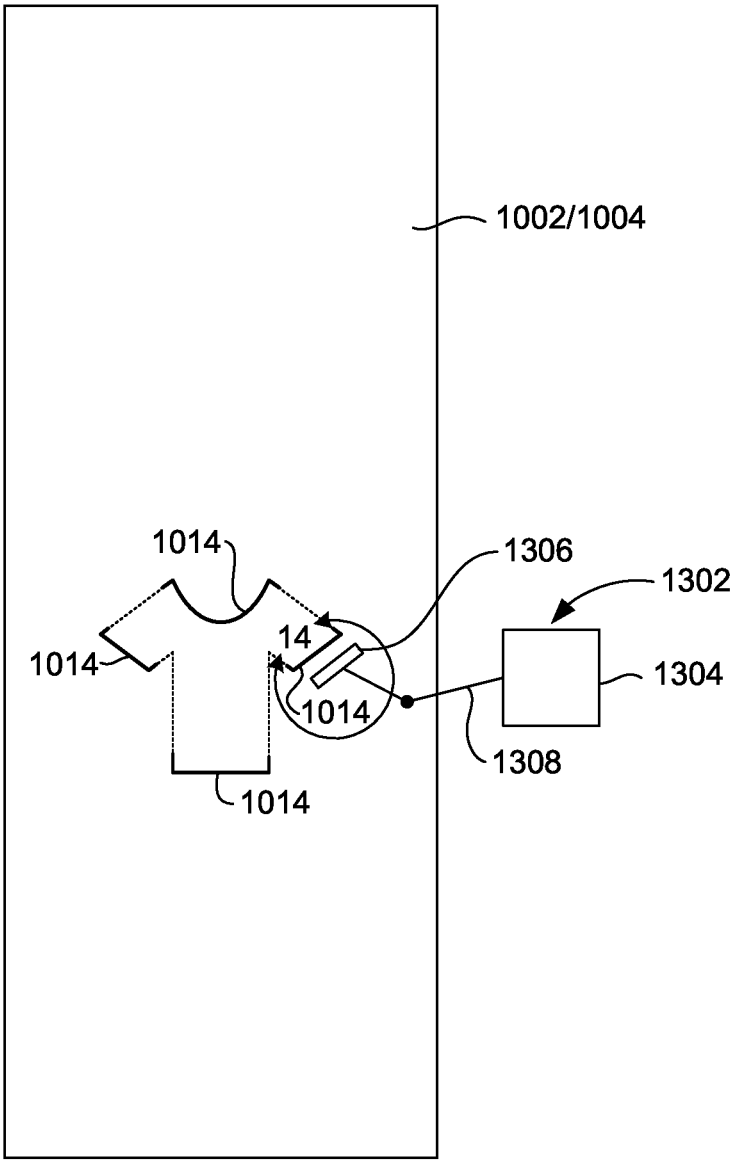
FIG. 13 is a top-down view of a pattern having notch cut portions of material folded over to form a hem.

FIG. 13 is a top-down view showing a tool 1302 for folding, creasing, and or pressing a hem. For purposes of clarity, the tool 1302 can be functional to fold press and crease the fabric layers 1002/1004 to form folded creases in each fabric layer 1002, 1004. The tooling 1302 can include a control system or circuitry 1304 which can control movement of a tooling head (referred to hereafter as folding tool 1306 for simplicity) through use of an articulating mechanism 1308, which may be an arm or other mechanism capable of moving the folding tool 1306 in three dimensions.

Figure 14:
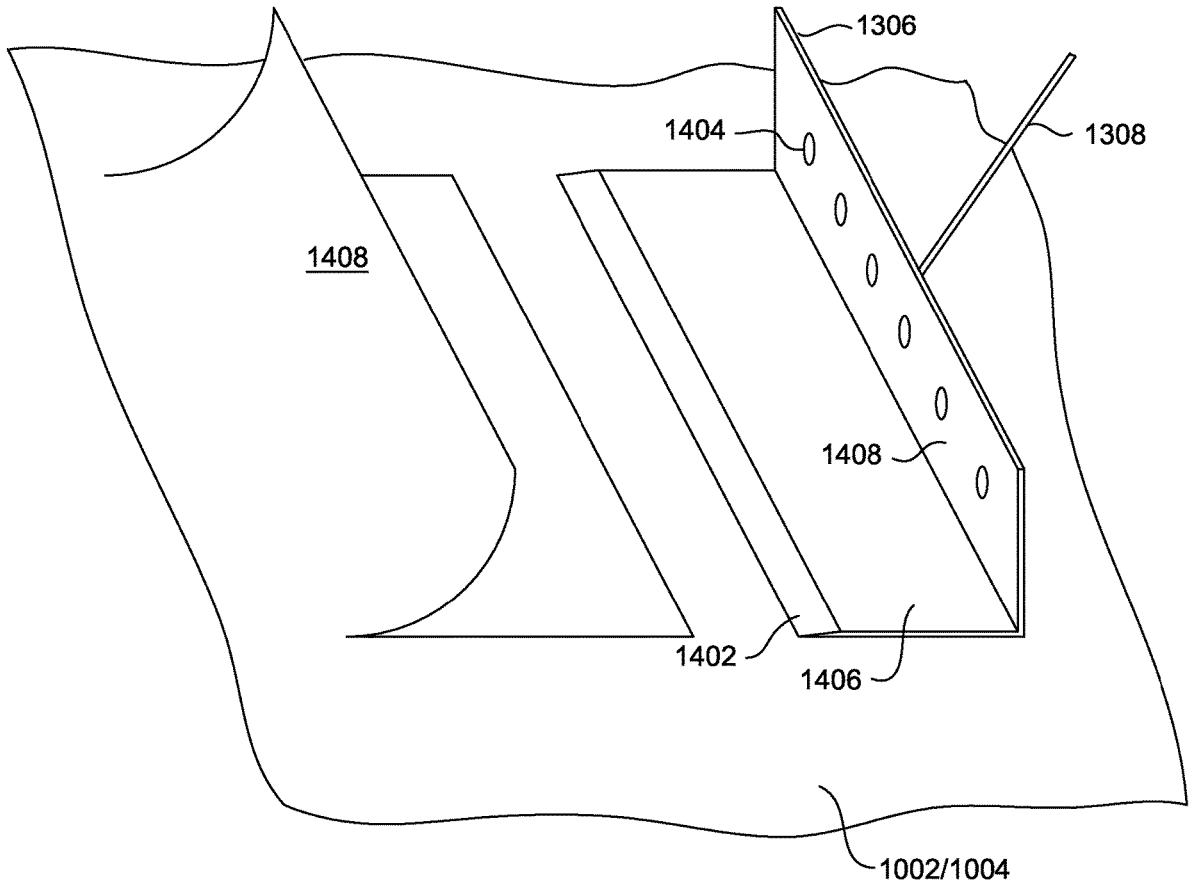
FIG. 14 is a perspective view of a notch cut material portion and a folding tool according to an embodiment.

FIG. 14 shows an enlarged, perspective view of the area in circle 14 of FIG. 13. The previously formed notch cut 1014 forms a flap 1408, that can bend upward and can be folded over. The formation of this flap is made possible by the previously described short cuts at the distal ends of the transvers cut line. As discussed above, the flap 1408 can be formed with slits 1202 as described above with reference to FIG. 12 to accommodate a curved hem. It should be pointed out that, when a material such as fabric, leather, upholstery, etc. is notch cut as described above, the material tends to curl upward as shown in FIG. 14. This can be used to advantage for the below described process. As shown in FIG. 14, the folding tool 1306 can have a bent shape, which can have an "L" shaped cross section having a bottom 1406 and back edge 1408 and can be configured with such a shape and size to slip into and under the notched cut portions of fabric layers 1002, 1004. To facilitate this, the folding tool 1306 can be configured with a beveled edge 1402 to help it to slip into and under each of the notch-cuts of the fabric layers 1002, 1004. The folding tool can also be configured with holes or openings 1404 that can be connected with tubing or other tooling elements (not shown) for providing steam, heat, air, mixture of a mist or steam and starch, etc. to facilitate forming a well-structured, creased fold.

Figure 15A:
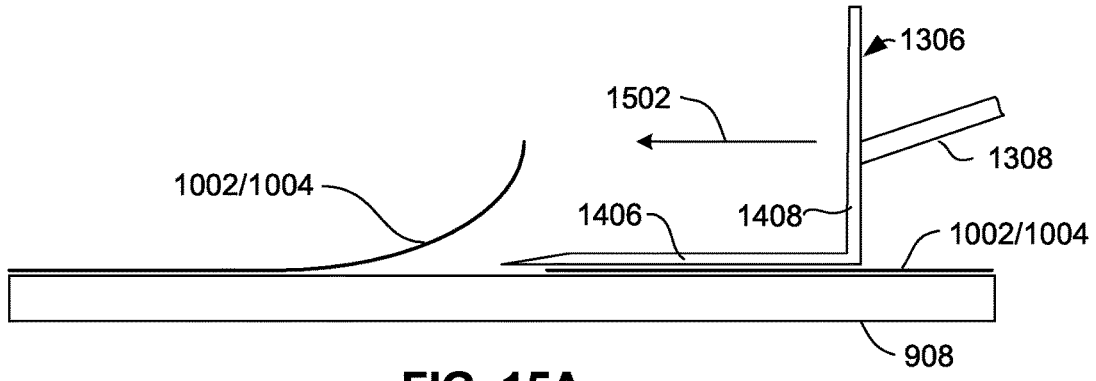
FIGS. 15A-15D are views of a folding tool according to an embodiment, showing different configurations of the folding tool during a folding/creasing operation.
Figure 15B:
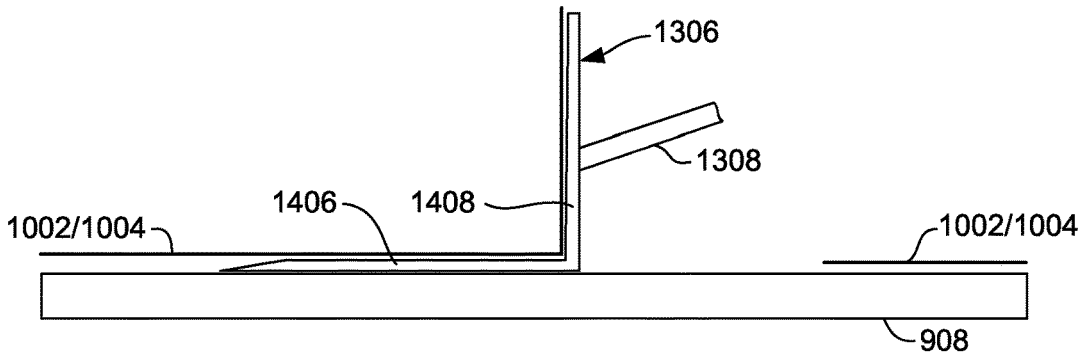
Figure 15C:
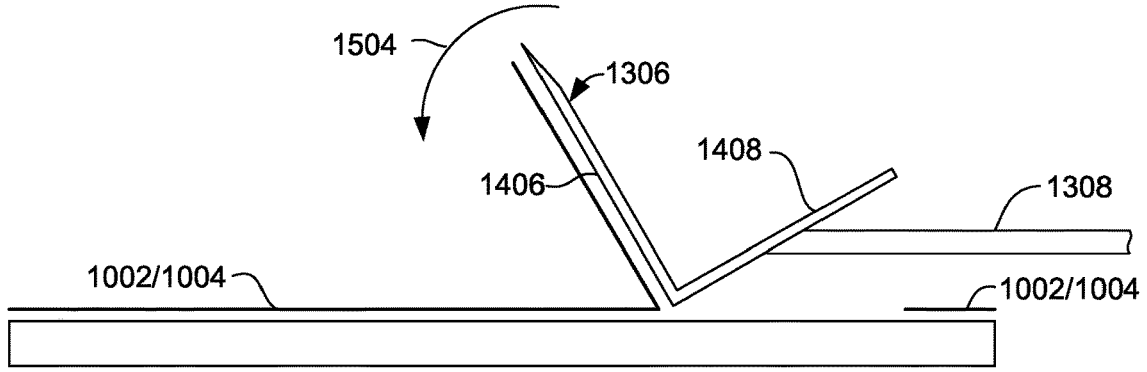

FIGS. 15A-15D illustrate a folding tool 1306 in various configurations in order to illustrate the folding and creasing of materials 1002, 1004 according to one embodiment. As shown in FIG. 15A, the folding tool 1306 can be moved horizontally toward the notch cut material 1002, 1004 (as indicated by arrow 1502) so that the bottom section 1406 of the folding tool 1306 slips under the materials 1002, 1004. The notch cut portion of the material 1002, 1004 rides up the back edge 1408 to extend upward in a vertical direction as shown in FIG. 15B. Steam, heat, air, water and starch mixture, etc. can be applied to the fabric through the openings 1404 (see FIG. 14) to help hold the material 1002, 1004 in an upright position or impart temporary stiffness to the fabric during the operation. In alternative embodiments, air or other gases may be blown through the openings 1404 (FIG. 14) to help lift the fabric 1002, 1004 during this process if needed.

Figure 15D:
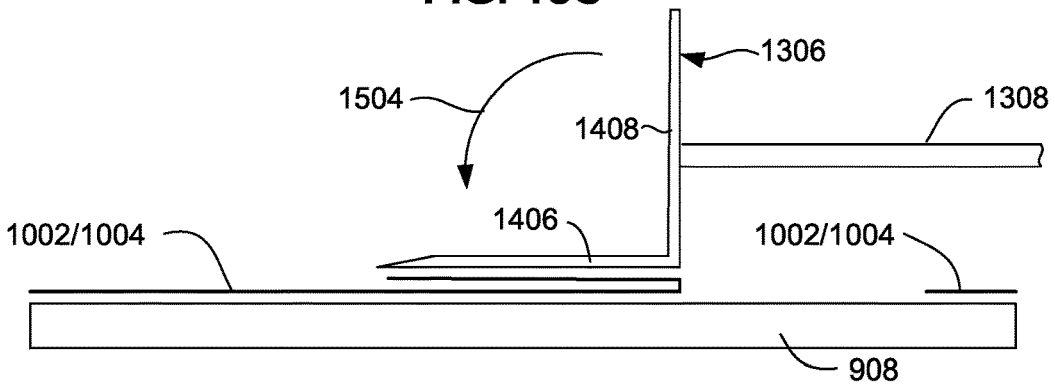

The folding tool 1306 can then be retracted horizontally away from the fabric 1002, 1004. After retracting, the folding tool 1306, the folding tool can pivot so that the bottom of the back edge 1406 faces the bent fabric 1002, 1004. The folding tool can then be tilted or rotated toward the fabric 1002, 1004 (counterclockwise as indicated by arrow 1504 in FIG. 15C) to bend the fabric 1002, 1004 back onto itself, finally pressing the fabric 1002, 1004 onto itself as shown in FIG. 15D. In alternative embodiments, steam, starch, size, etc. can be applied to the fabric 1002, 1004 through openings 1404 (FIG. 14) as desired.

Figure 16:
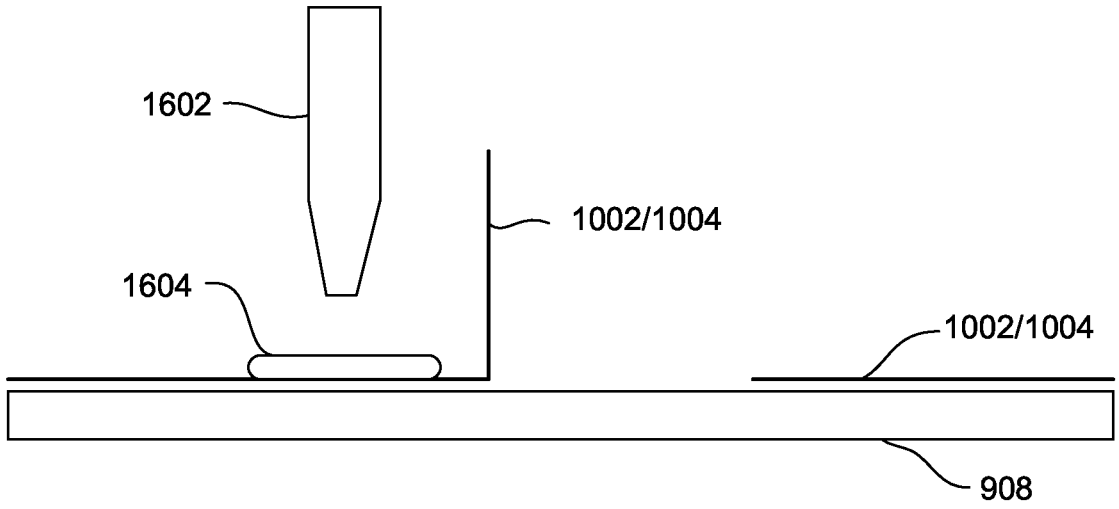
FIG. 16 is a side, cross-sectional view illustrating the application of an adhesive or other joining material.

After this process has been performed, the folding tool can be removed from the fabric 1002, 1004. The fabric 1002, 1004 may then have a creased shape as shown in FIG. 16, wherein the notch-cut portion of the fabric extends upward on its own. At this point, according to one embodiment, an applicator tool 1602 can be used to apply adhesive 1604 to the fabric 1002, 1004 at a location adjacent to the crease as shown in FIG. 16. This is according to one exemplary embodiment, as other affixing means may be employed, such as for example applying a double-sided tape heat treatable film, sewing, etc.

In alternative embodiments, the application of adhesive 1604 using the applicator tool 1602 may occur just before or during the process of folding of the fabric 1002/1004 with the folding tool 1308. For example, in one embodiment, the adhesive 1604 can be applied at the stage shown in FIG. 15B or 15C, without first forming a crease.

Figure 17:
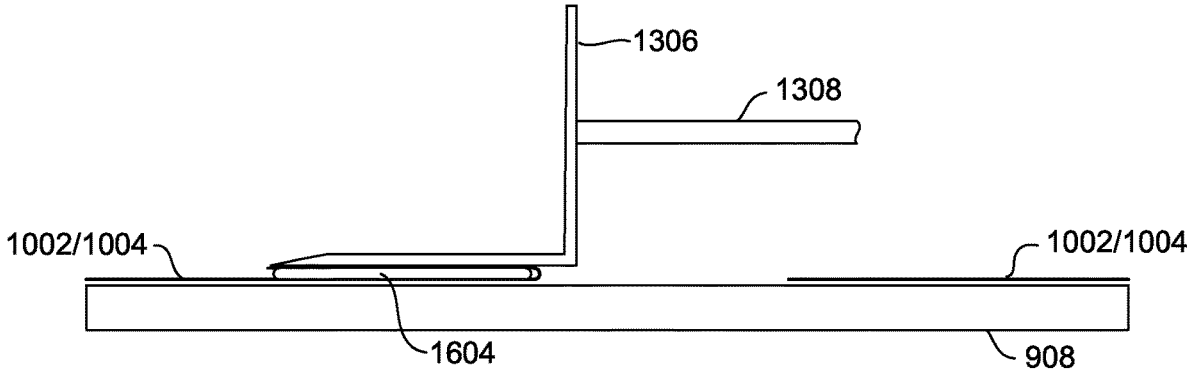
FIG. 17 is a side cross-sectional view of a folding tool according to an embodiment being used to affix a hem.

With reference now to FIG. 17, the folding tool 1306 can be used to press the notch cut portion of material 1002, 1004 down onto the adhesive, tape, etc. 1604. The movement of the folding tool 1306 may be similar to that described above with reference to FIGS. 15C and 15D. In some embodiments, the folding tool 1308 may apply heat, steam and pressure to help activate the applied adhesive and form the hem.

Figure 18A:
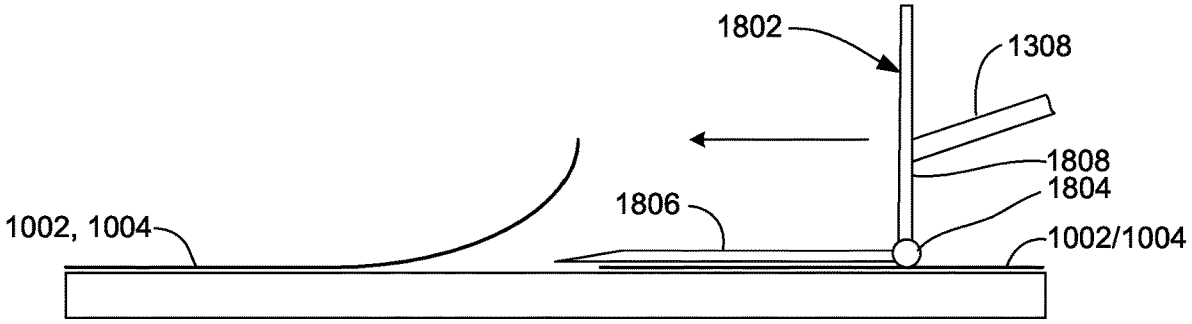
FIGS. 18A-18D are views of a folding tool according to an alternate embodiment, showing different configurations of the folding tool during a folding/creasing operation.
Figure 18B:
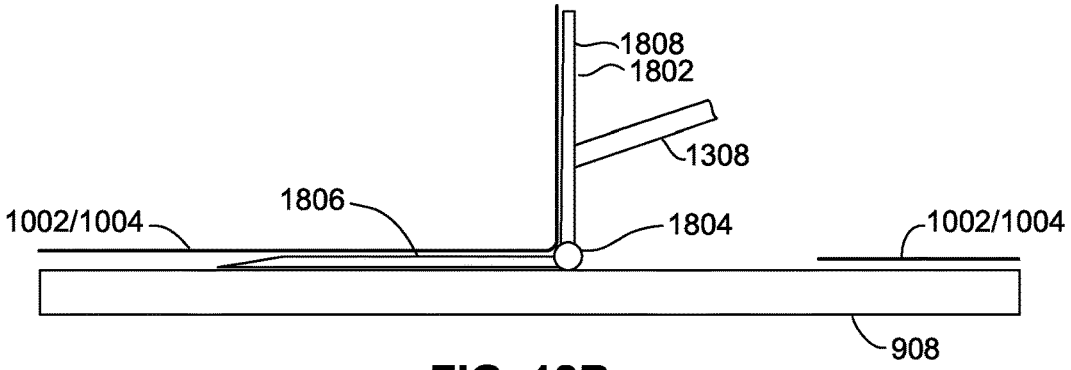

FIGS. 18A-18D and 19 show a process for folding a hem according to alternative embodiments. FIG. 18A shows a folding tool 1802 according to an alternate embodiment. The folding tool 1802 has a hinge 1804 joining a bottom portion 1806 and back edge 1808. The hinge 1804 can be a spring hinge or could be a mechanically operated and actuated hinge, or some other type of hinge. As with the previously described embodiments, the folding tool 1802 can be moved horizontally to slip under the notch cut portion of the fabric 1002, 1004. This can cause the fabric to fold up the back edge 1808 of the folding tool 1802 as shown in FIG. 18B.

Figure 18C:
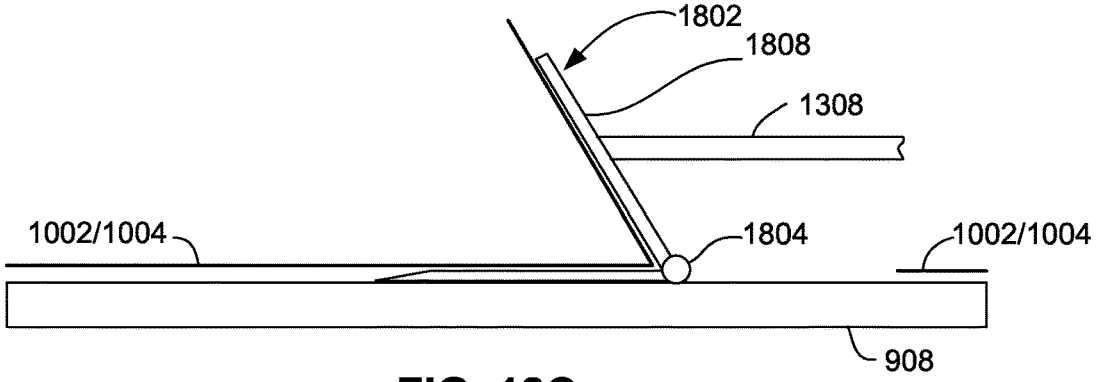
Figure 18D:
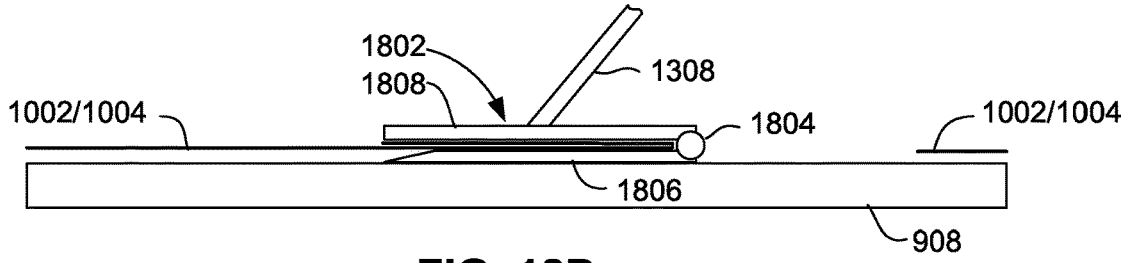
Figure 19:
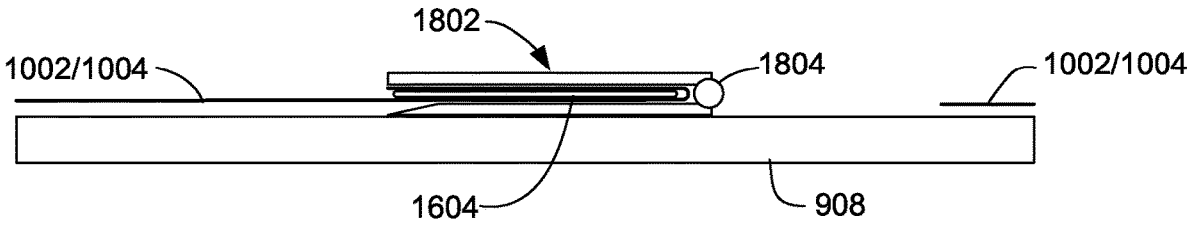
FIG. 19 is a side cross-sectional view of a folding tool according to an alternate embodiment being used to affix a hem.

Because the tooling 1802 has a hinged connection 1804, the back edge 1807 of the tooling can be bent over to press the sections of the fabric layers 1002, 1004 down upon themselves as shown in FIGS. 18C and 18D. With reference to FIG. 19, the folding tool 1802 can be released and an adhesive, tape, etc. 1604 applied as previously described and the hinged back edge of the folding tool pressed back down upon to press the fabric down upon the adhesive, tape, etc. 1902. In an alternative embodiment, rather than using a bonding agent 1902, the hem can be affixed other methods such as sewing.

Figure 20:
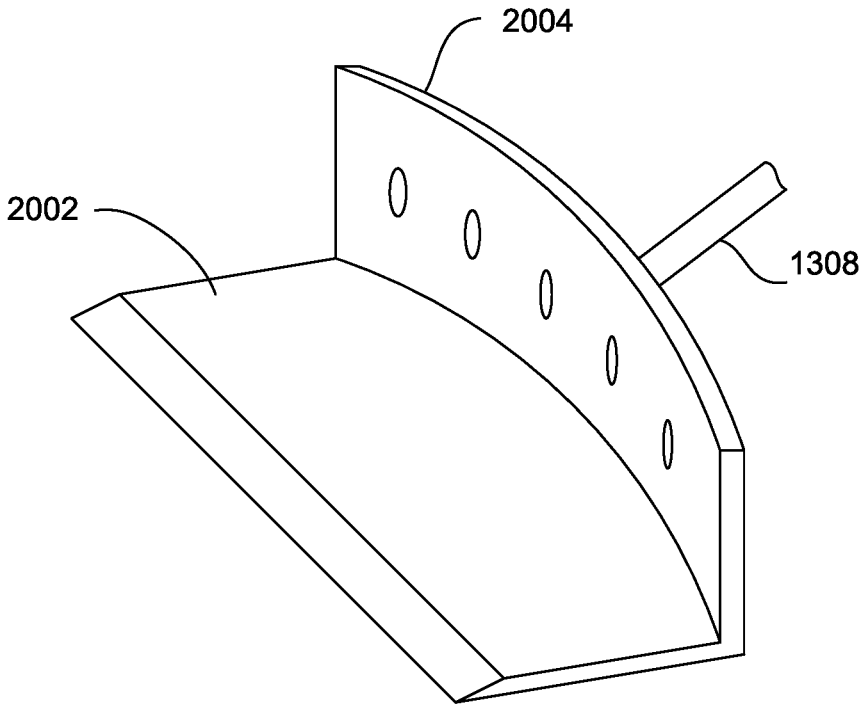
FIG. 20 is a perspective view of a folding tool according to an alternate embodiment.

The above-described folding tool 1802 can be configured in different shapes and sizes to accommodate various hem patterns. For instance, folding tools may come in various lengths to accommodate different sizes of notch cuts. In addition, it may be desirable to form cutting tools with unique shapes to accommodate non-linear cut shapes. With reference to FIG. 20, a tool 2002 may be configured with a back edge 2004 that is curved to accommodate folding a curbed hem. Although the tool 2002 is shown as having a concave back edge 2004, the tool 2002 could also be formed with a convex back edge 2004 that curves in a direction opposite that shown in FIG. 2, such as for folding a hem of a neckline of a shirt. Note that in FIG. 20, the hinge 804 is not shown.

Figure 21:
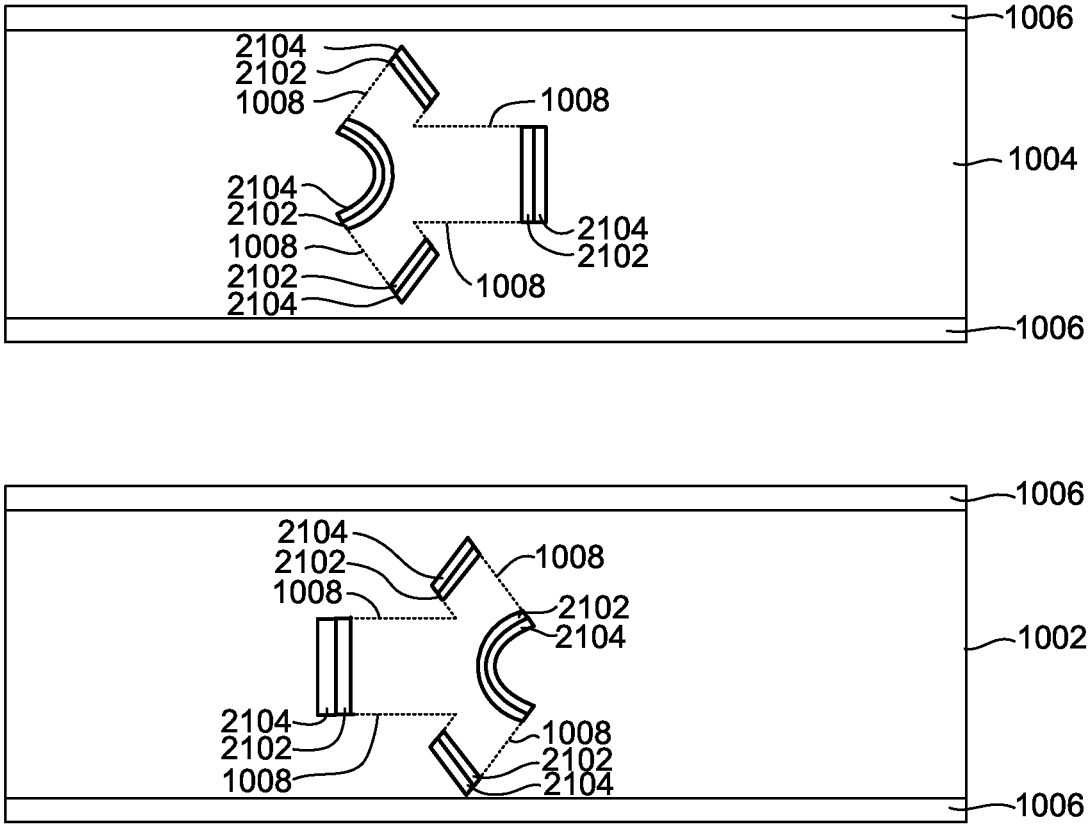
FIG. 21 is a top-down view of two material portions having hems formed, prior to adjoining different pattern pieces together.
Figure 22:
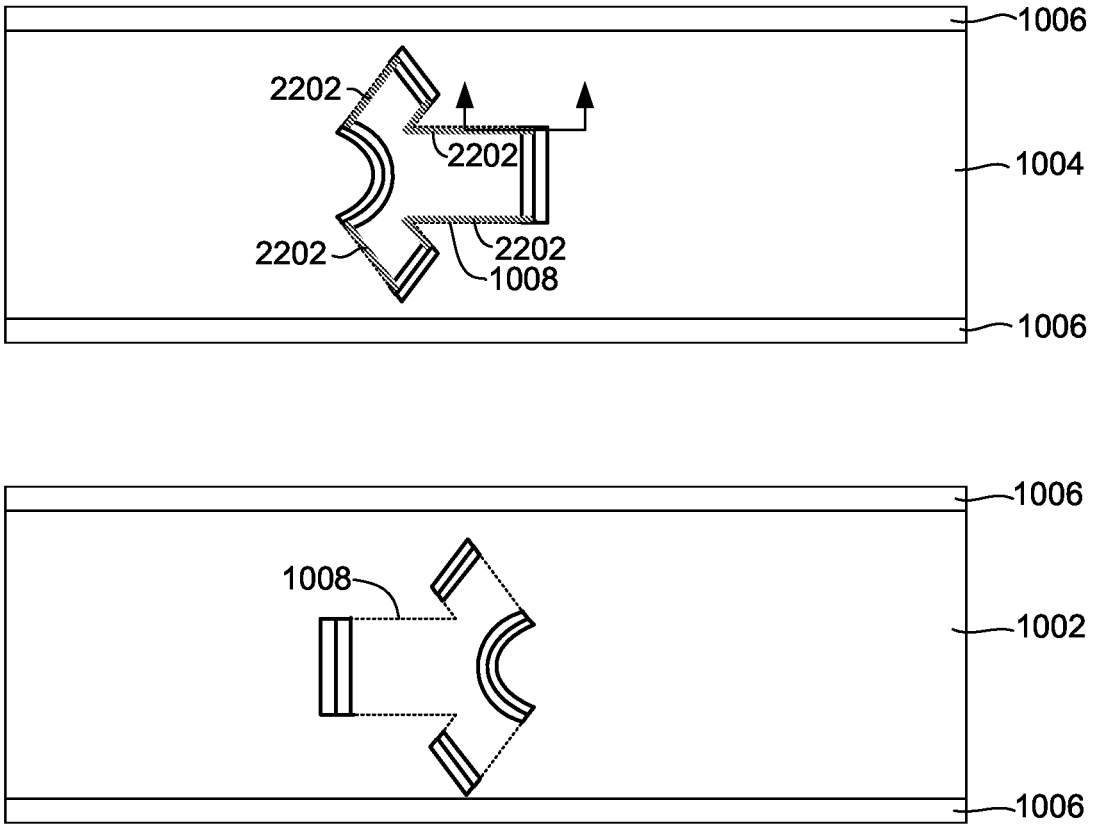
FIG. 22 is a top-down view of two material portions having hems formed after application of an adhesive or other joining material.

FIG. 21 shows a top-down view of two portions of fabrics 1002, 1004, with hems 2102 formed as described above. Sections 2104 adjacent to the hems 2102 are portions cut out of the fabrics 1002 or 1004. Again, the dotted line 1008 indicates a pattern shape and location where future manufacturing processes will be performed. With reference to FIG. 22, a liquid adhesive, adhesive tape or other fastening means 2202 may be applied to selected portions of the materials 1002, 1004. While the bonding material 2202 could comprise of various materials or devices such as, but not limited to adhesive, tape, etc., for purposes of clarity the material 2202 will simply be referred to herein as adhesive 2202. In FIG. 21, it can be seen that the hems 2102 are formed at locations where there will be an opening in the finished workpiece item (shirt in this example). The adhesive 2202 is located along edges of the pattern where two or more patterns are to be joined together. In FIG. 22, it can be seen that the adhesive 2202 has been applied to only one of the fabric layers 1002 and 1004. However, this is an example of one embodiment, and the adhesive could also be applied to both fabric layers 1002, 1004.

After applying the adhesive 2202, the two fabric layers 1002, 1004 can be pressed together to join the two patterns 1008 long the adhesive lines to form in this example a T-shirt. It should be noted that the T-shirt may still be at least partially attached to one of the fabric layers 1002 or 1004. It should also be noted that various processes can be employed to join the two fabric layers 1002, 1004. The application of the adhesive 2202 is merely an example. The process can also include other means, such as, but not limited to applying heat or welding the two portions together, stitching, or otherwise joining the two material pieces 1002, 1004. The two fabric layers 1002, 1004 can also be connected by sewing. The joined patterns can then be cut out from the material portions leaving a finished garment or other item. After the two fabric layers 1002, 1004 have been joined together and cut out from the main piece of fabric, the finished article can be turned inside-out to have all of the seams and hems on the inside for a more appealing article or garment.

Figure 23:
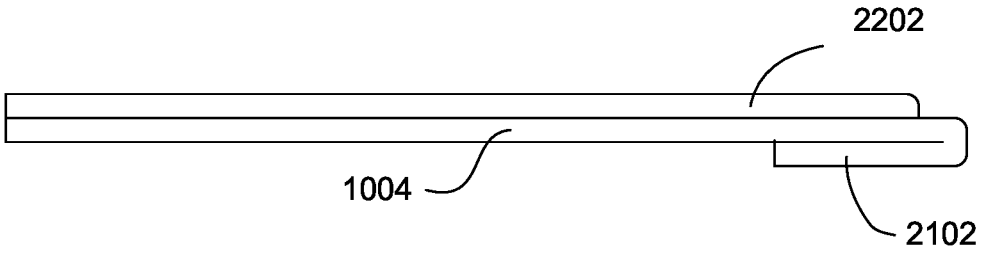
FIG. 23 is an enlarged cross-sectional view as seen from line 23-23 of FIG. 22.

FIG. 23 shows an enlarged perspective view of two pieces of fabric 1002, 1004 after they have been joined and bonded together to form a seam and cut out from the fabric web. FIG. 23 shows to hemmed ends and an adhesive 2202 forming a seam that runs perpendicular to the hem 2302. As can be seen in FIG. 23, the hem folds are directed outward, and the adhesive 2202 contacts the fabric portions 1002, 1004 at the side opposite the hem folds 2302. In alternative embodiments, multi-fold or multi-layer seams may be formed by folding the material in different ways. When the garment or other item is turned inside out as described above, the fabric will separate, and both the hem folds 2302 and seam formed by the adhesive 2202 will be concealed inside of the garment or other item.

Figure 24A:
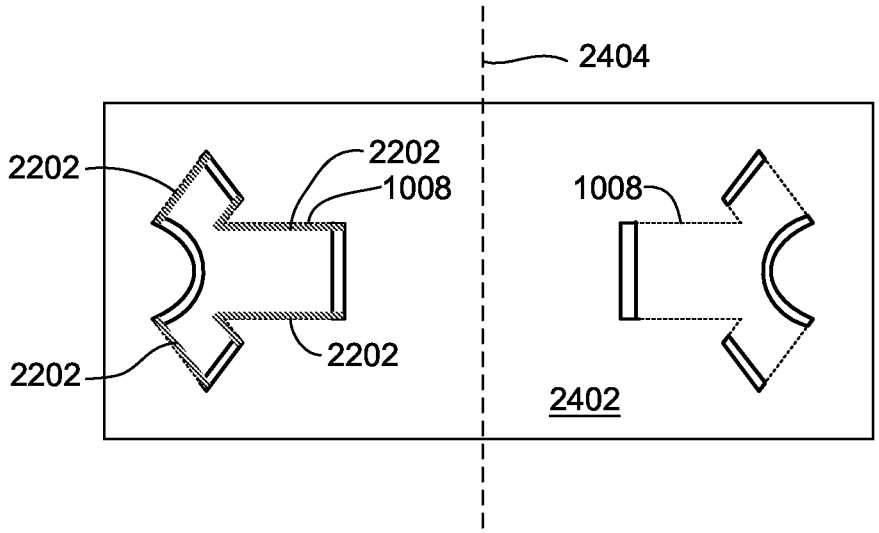
FIGS. 24A and 24B are top-down views of first and second material portions that are part of a single common material portion.

While the above has described a process in terms of two separate material web 1002, 1004, the material portions could also be portions of the same, common web of material. For example, with reference to FIG. 24A, the patterns 1008 can be arranged end to end on a common piece of material 2402. The material portions can be folded over a fold line 2404 to join the patterns 1008 together. Alternatively, the material piece 2402 can be cut after forming the hemmed patterns 1008 and then the two pieces can be joined together.

Figure 24B:
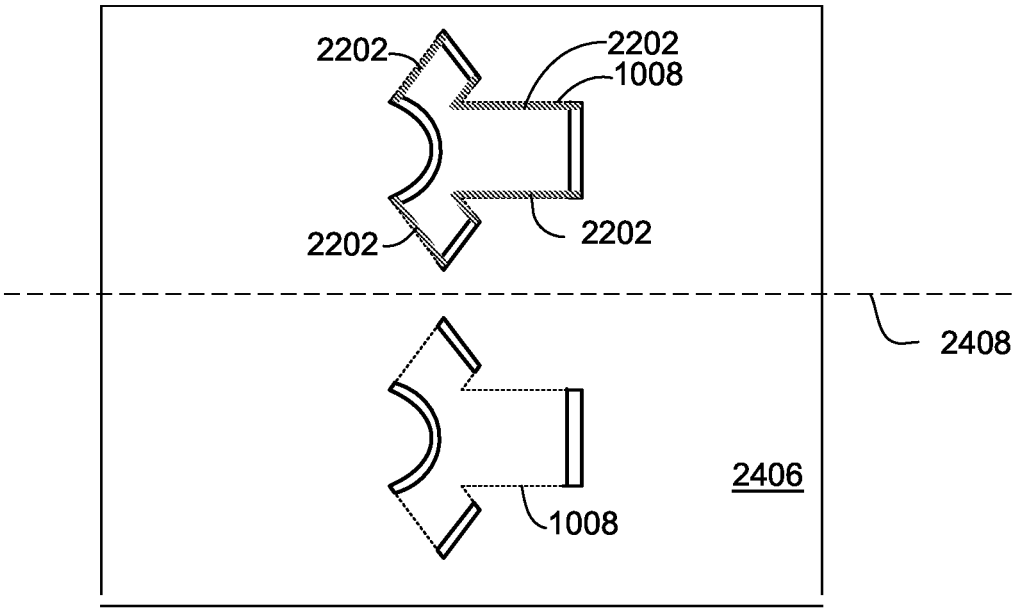

Alternatively, with reference to FIG. 24B, the patterns 1008 can be arranged side by side on a common piece of material such as a common fabric web 2406. The material 2406 can then be folded over at line 2408 to join the pattern pieces 1008 together. In another embodiment, the material 2406 can be cut along line 2408 and the patterns 2406 can be joined together.

Figure 25:
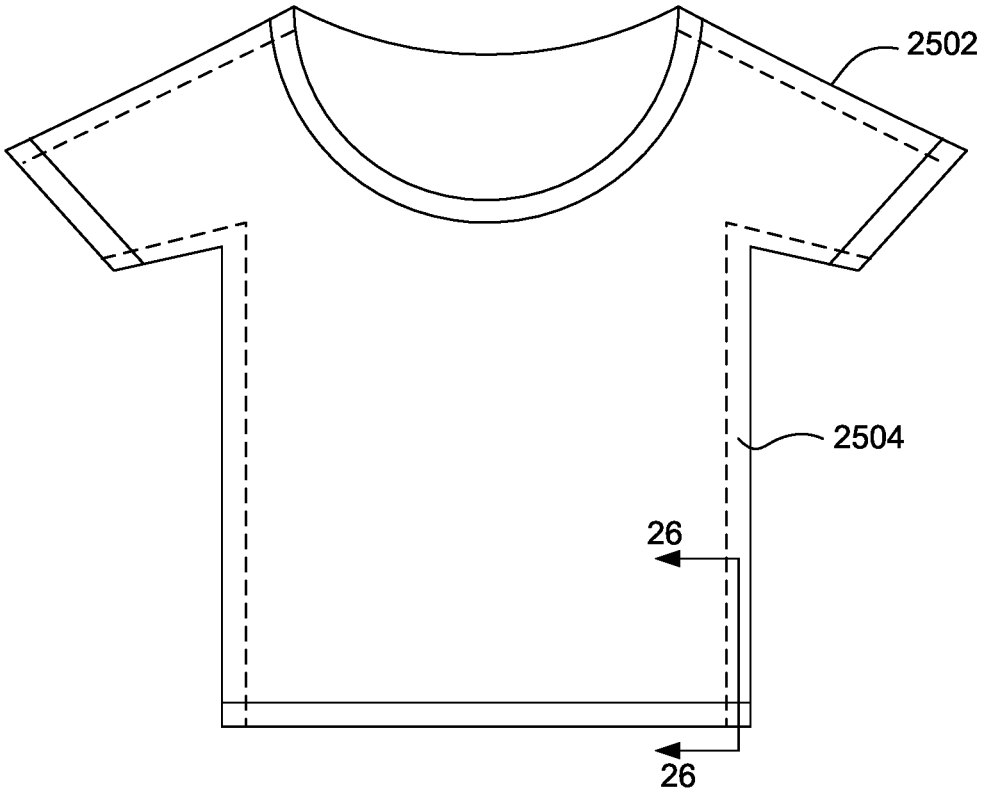
FIG. 25 is a view of a workpiece formed by joining two material patterns together to form seams.

An example of a joined and cutout workpiece 2502 can be seen with reference to FIG. 25. The material pieces may be joined together using adhesive or other joinder techniques including sewing as described above results in a seam 2504.

Figure 26:
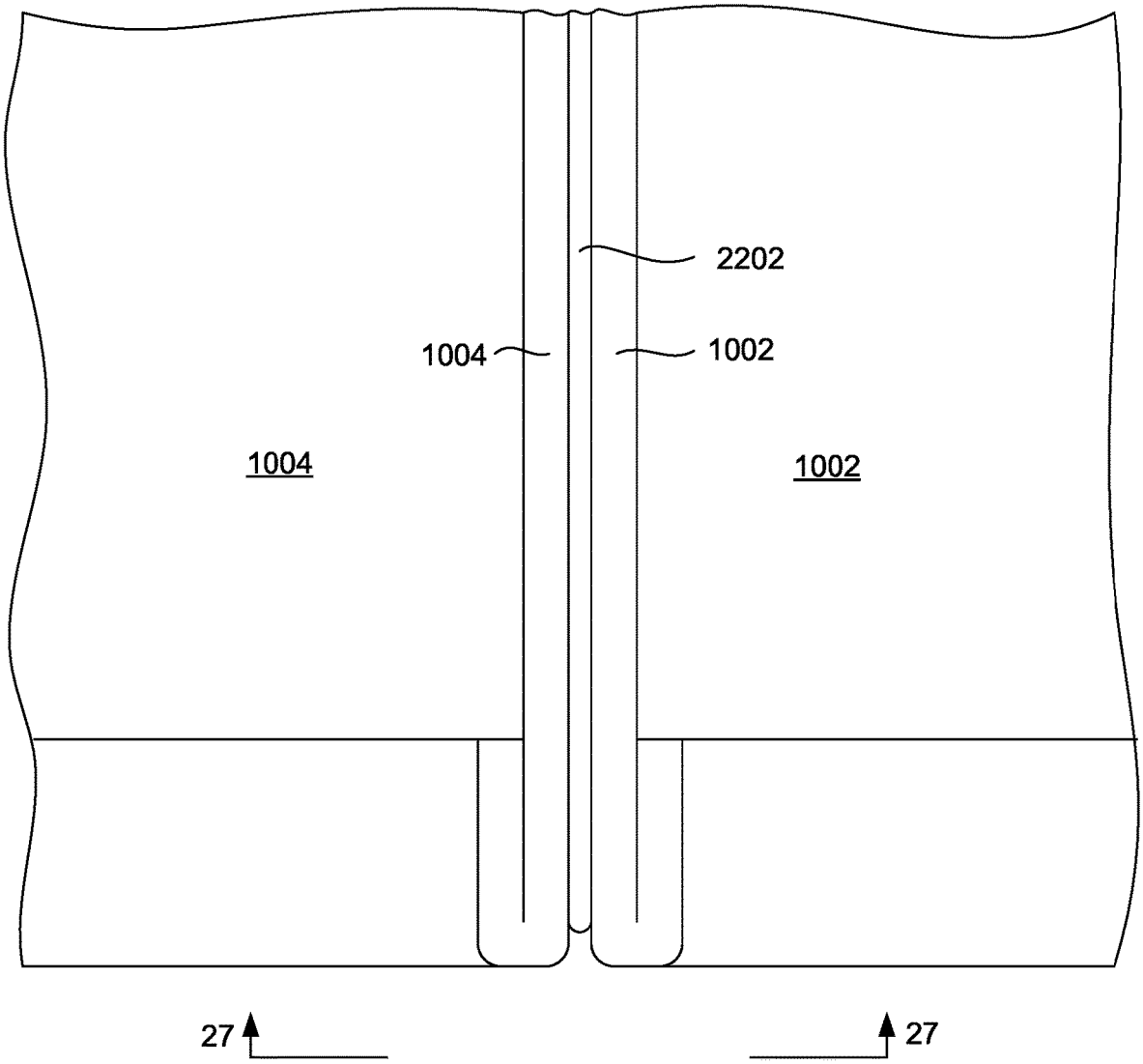
FIG. 26 is an enlarged, cross-sectional view as seen from line 26-26 of FIG. 25.
Figure 27:
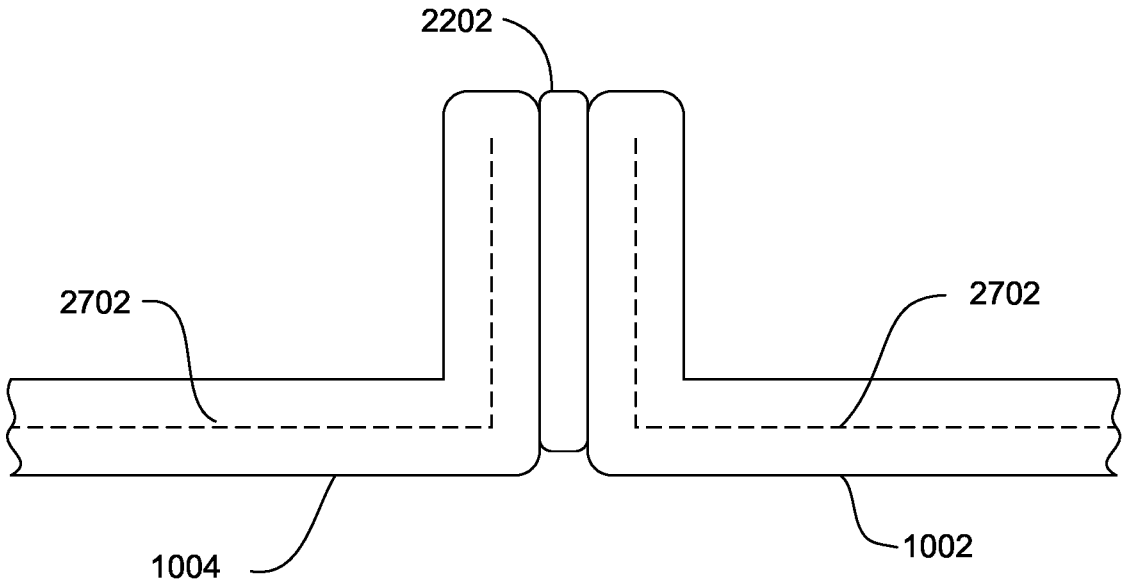
FIG. 27 is an end view seen from line 27-27 of FIG. 26.

FIG. 26 is a cross sectional view as seen from line 26-26 of FIG. 25, showing a cross section along a portion of the joined seam 2504. FIG. 26 shows a view of the seams and hems as would be seen from the inside of the finished garment. The hem and seam are both hidden on the inside of the garment so at to not be visible at the outside of the garment. FIG. 27 is an end view as seen from line 27-27 of FIG. 26. The dashed lines 2702 indicate that the fold of the hem is concealed behind the material 1002, 1004 in this end view.

Applying the adhesive 2202 on a side opposite the folded over portion of the hem 2102 provides for a cleaner design and a more visually appealing seams in the finished articles. The garment or item is preferably initially be formed with the outside inside of the garment facing outward and then flipped inside-out to allow the seams and hems to be folded toward the inside of the garment.

Figure 28:
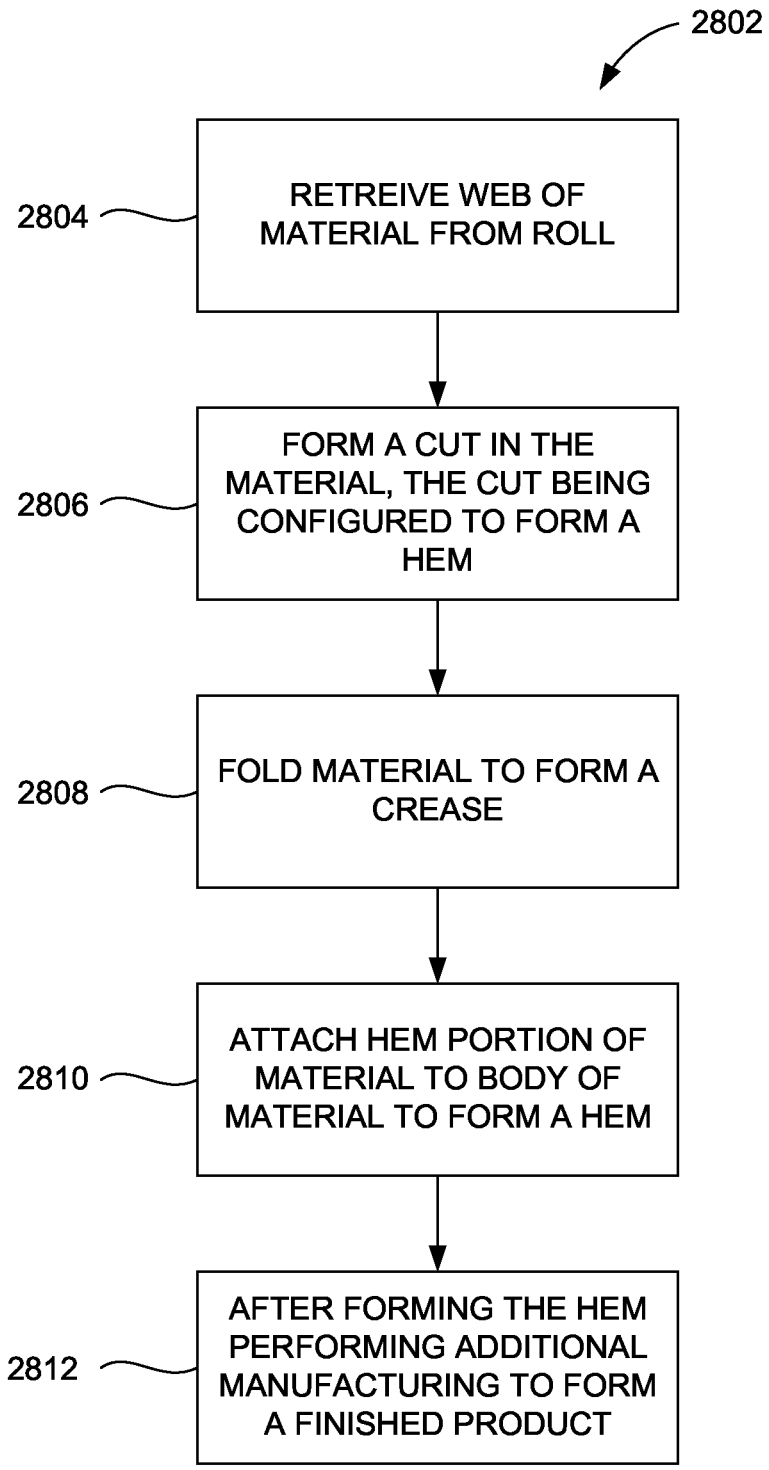
FIG. 28 is a flowchart summarizing a method for forming a hemmed workpiece.

FIG. 28 is a flowchart summarizing a method 2802 for manufacturing a workpiece according to an embodiment. In an operation 2804, a web of material is retrieved from a roll of material. The material can be a flexible material such as fabric, felt, leather, upholstery, etc. and can be a material suitable for the construction of garments, linens, accessories such as bags purses, etc. The material can be dispensed from a first roll and retrieved from another roll in such a manner that the material is suspended and conveyed directly by pulling on the item relatively flat.

A cut is formed in the material in operation 2806. The cut can be configured to form a hem and can be formed as a notch shape in the material. The notch can be configured as a larger main cut, with smaller end cuts at either end of the main cut and which may be formed at an angle of substantially 90 degrees relative to the main cut. The cut can be formed by various manufacturing processes, such as by laser cutting, or with use of a knife, saw, scissors, etc. The flap portion of the main cut is folded onto the material itself, to form a crease in operation 2808. The folding of the fabric can include the use of steam, heat starch, size, etc. and can involve the use of automated or manual folding tooling. In operation 2810, a flap portion of the cut material is affixed to a main body portion of the material to form a hem. Methods for affixing the hem portion to the main body can include the use of an adhesive, stitching, welding, sewing etc. The attachment may also include the application of heat air or chemical to a bonding agent. Then, in operation 2812, after forming the hem, further additional manufacturing processes are performed to form a finished item. This further forming can include seaming processes to join the material to another item of material. The further processing can also include joining an edge of the material to itself such as by seaming to form a finished workpiece or intermediary workpiece.

Forming the hem prior to performing other later manufacturing processes advantageously allows the hemming process to be performed while the material is flat rather than after the material has been formed into a three-dimensional workpiece such as a garment. This greatly facilitates automating the hemming process by simplifying the environment in which it is performed and minimizing the physical manipulation required during the hemming process.

Figure 29:
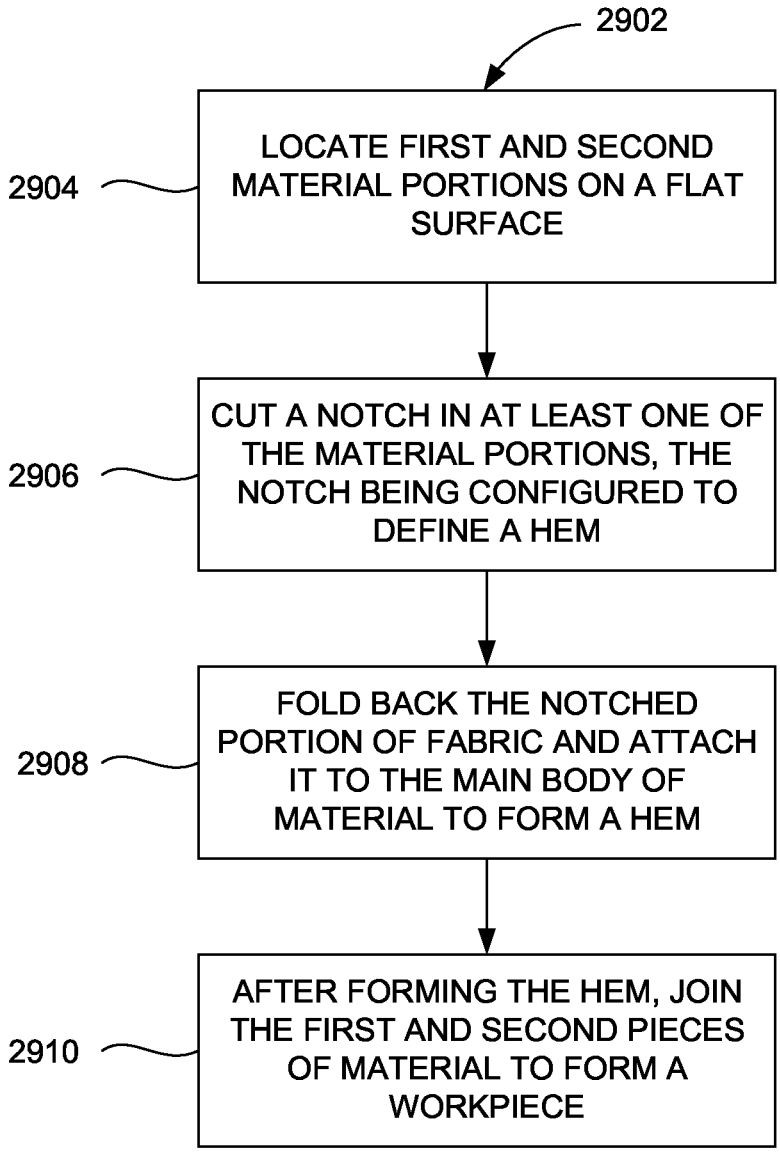
FIG. 29 is a flowchart summarizing a method for forming a hemmed workpiece according to an alternate embodiment.

FIG. 29 is a flowchart illustrating a method 2900 for manufacturing an item according to another embodiment. In operation 2904, first and second material portions are placed on, laid on or otherwise supported by a flat surface. This allows the material pieces to be held flat while also being relaxed and not under tension. The material can be fabric, upholstery, leather, vinyl or some other similar material. The flat surface could be a conveyor belt, workstation, table, etc.

In operation 2906, a notch is then cut into at least one of the material portions, the notch being configured to define a hem. In some embodiments notches can be formed on both material portions. In some embodiments, several notches can be formed in each material portion. In some embodiments, the material pieces are intended for forming a garment, and the notches are at locations which will be open portions of the garment such as, but not limited to sleeve openings pant leg openings shirt bottom or neck openings etc.

In operation 2908, the notched portion is then folded back and attached to the main body of the material portion to form a. The folding back of the notched portion can include creasing pressing, steaming, starching, sizing etc. The attachment of the notched portion to the main body of the material portion can be achieved by applying an adhesive or tape, sewing, welding or some other suitable attachment means.

In operation 2910, after the hem has been formed, the first and second material portions are joined together to form a workpiece 1910. The workpiece can be a finished workpiece such as a garment in one embodiment. In another embodiment, the workpiece can be an intermediate workpiece intended to be connected with other workpieces to form a finished product. The joining of the first and second material portions can be performed by application of an adhesive or tape, welding, sewing, etc. In one embodiment, the first and second material portions can be separate material portions. In one embodiment, the first and second material portions can be separate webs of material such as fabric fed from rollers. In one embodiment the first and second material portions can be portions of a common material piece that can be folded over to connect the two material portions or which can be cut into two separate material portions before joining the two material portions.

While various embodiments have been described above, it should be understood that they have been presented by way of example only and not limitation. Other embodiments falling within the scope of the invention may also become apparent to those skilled in the art. Thus, the breadth and scope of the invention should not be limited by any of the above-described exemplary embodiments but should be defined only in accordance with the following claims and their equivalents.

What is claimed is:

1. A system comprising:

a tool head comprising:

a folding tool having a flat base configured to fit under a portion of material and a back extending upward from the flat base; and a cutting tool configured to cut a slit that defines a flap in the portion of material; and an articulating mechanism for moving the tool head in multiple dimensions;

a control system for controlling the articulating mechanism to slide the folding tool under the flap in the portion of material and fold the flap in the portion of material.

2. The system of claim 1, wherein the tool head includes openings for supplying one or more of heat, steam, air, or starch to the material.

3. The system of as in claim 1, wherein the flat base of the folding tool has a beveled edge to facilitate sliding the folding tool under the flap in the portion of material.

4. The system of claim 1, wherein the articulating mechanism is configured to slide the folding tool under the flap in the portion of material and also rotate the folding tool so as to bend, crease and press the flap in the portion of material.

5. The system of claim 1, wherein the cutting tool is configured to extend or retract along an axis perpendicular to a plane of the material.

6. The system of claim 1, wherein the cutting tool is configured to travel along a path defined by a combination of coordinates and rotate in a clockwise or a counterclockwise direction with respect to the material.

7. The system of claim 1, wherein the cutting tool comprises one or more of:

a knife, a blade, a scissor, or a needle.

8. The system of claim 1, wherein the control system further comprises one or more processors, wherein the one or more processors are configured to:

cause the articulating mechanism to move the tool head to a location corresponding to the portion of material to cut with the cutting tool a first slit that defines a first flap of material;

cause the articulating mechanism to move the tool head to fold with the folding tool the flap of material and affix the flap of material onto a first portion of the material to form a hem; and cause the articulating mechanism to move the tool head to apply pressure to join the first portion of material having the hem to a second portion of material.

9. The system of claim 8, further comprising an applicator tool configured to apply adhesive to the second portion of material prior to the folding and affix the flap of material onto the second portion of material to form the hem.

10. A system for manufacturing a garment comprising:

a tool head comprising:

a folding tool having a flat base configured to fit under a piece of material and a back extending upward from the flat base; and a cutting tool configured to cut a slit that defines a flap in a portion of material;

an articulating mechanism configured to move the tool head in multiple dimensions; and a control system comprising one or more processors, wherein the one or more processors are configured to:

cause the articulating mechanism to move the tool head a location on a continuous web of material to cut with the cutting tool the slit;

cause the articulating mechanism to move the tool head to fold, with the folding tool, the flap of material and affix the flap of material onto a portion of the continuous web of material to form a hem; and cause the articulating mechanism to move the tool head to apply pressure to join a first portion of the continuous web having the hem to a second portion of the continuous web of material.

11. The system of claim 10, wherein the tool head further comprises one or more openings configured to supply one or more of heat, steam, air, or starch to the material.

12. The system of claim 10, wherein the flat base of the folding tool includes a beveled edge to facilitate sliding the tool head under the flap in the portion of material.

13. The system of claim 10, wherein the articulating mechanism is configured to slide the folding tool under the flap of material and rotate the folding tool-to bend, crease, or press the flap in the portion of material.

14. The system of claim 10, wherein the application of pressure to join the first portion of the continuous web of material to the second portion of the continuous web of material forms a garment.

15. The system of claim 10, further comprising an applicator tool configured to apply adhesive.

16. The system of claim 15, wherein the one or more processors are configured to cause the applicator tool to apply adhesive to the portion of the continuous web of material prior to the folding of the flap of material.

17. The system of claim 10, wherein the one or more processors are configured to cause the articulating mechanism to move the tool head to a location on the continuous web of material to cut with the cutting tool a first notch that corresponds to a neck hole curve of the first portion that has a different radius of curvature from a second notch that corresponds to a neck hole curve of the second portion.

18. The system of claim 10, wherein the cutting tool comprises one or more of:

a knife, a blade, a scissor, or a needle.

19. The system of claim 10, wherein the cutting tool is configured to extend or retract along an axis perpendicular to a plane of the material.

20. The system of claim 10, wherein the cutting tool is configured to travel along a path defined by a combination of coordinates and rotate in a clockwise or a counterclockwise direction with respect to the material.

* * * * *